US008038248B2

(12) United States Patent
Uchino et al.

(10) Patent No.: US 8,038,248 B2
(45) Date of Patent: Oct. 18, 2011

(54) IMAGE RECORDING APPARATUS

(75) Inventors: Yuta Uchino, Nagoya (JP); Takashi Ohama, Iwakura (JP); Wataru Sugiyama, Aichi-ken (JP); Noriyuki Kawamata, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 802 days.

(21) Appl. No.: 12/055,302

(22) Filed: Mar. 25, 2008

(65) Prior Publication Data

US 2009/0051720 A1 Feb. 26, 2009

(30) Foreign Application Priority Data

Mar. 29, 2007 (JP) ..... 2007-089874
Mar. 29, 2007 (JP) ..... 2007-089919

(51) Int. Cl.
*B41J 29/38* (2006.01)
*B65H 29/00* (2006.01)

(52) U.S. Cl. ..... 347/16; 271/186
(58) Field of Classification Search ..... None
See application file for complete search history.

(56) References Cited

U.S. PATENT DOCUMENTS 5,374,049 A * 12/1994 Bares et al. ..... 271/186
6,185,405 B1 2/2001 Sueoka
6,652,060 B2 11/2003 Uchida
6,938,974 B2 9/2005 Uchida
7,270,392 B2 9/2007 Mizuno

FOREIGN PATENT DOCUMENTS

JP H06-134982 A 5/1994
JP H11-079469 B2 3/1999
JP 2001083747 A 3/2001
JP 2002148879 A 5/2002
JP 2003048311 A 2/2003
JP 2004224057 A 8/2004
JP 2004314505 A 11/2004
JP 2004354422 A 12/2004

* cited by examiner

*Primary Examiner* — Stephen Meier
*Assistant Examiner* — Alexander C Witkowski
(74) *Attorney, Agent, or Firm* — Baker Botts L.L.P.

(57) ABSTRACT

An image recording apparatus according to an aspect of the invention comprises a first roller pair disposed downstream of a recording unit; a second roller pair disposed downstream of the first roller pair; an inversion guide portion that connects a downstream portion of a conveying path positioned downstream of the recording unit to an upstream portion of the conveying path positioned upstream of the recording unit; a path changeover unit configured to send the recording medium conveyed from the recording unit with a first end as a leading end to the inversion guide portion with the second end as a leading end. In a stop operation, rotation of the first roller pair and the second roller pair stops in a state where the first roller pair nips a vicinity of the second end of the recording medium and the second roller pair also nips the recording medium.

21 Claims, 16 Drawing Sheets

IMAGE RECORDING APPARATUS

CROSS-REFERENCE TO RELATED APPLICATIONS

This application is based upon and claims the benefit of priority from Japanese Patent Application No. 2007-089874 filed on Mar. 29, 2007, and Japanese Patent Application No. 2007-089919 filed on Mar. 29, 2007, the entire contents of which are incorporated herein by reference.

TECHNICAL FIELD

The present invention relates to an image recording apparatus capable of performing a double-sided printing on a recording medium.

BACKGROUND

An image recording apparatus capable of performing a double-sided printing to record images on both sides of a recording sheet has been proposed (see, for example, JP-A-2001-83747). The image recording apparatus of this type feeds a recording sheet from a sheet feeding tray and conveys the fed sheet along a conveying path. An inkjet recording unit disposed along the conveying path ejects ink droplets to one side of the recording sheet, thereby recording an image. Subsequently, the recording sheet is sent back to an inversion path by a pair of discharge rollers and again fed to an upstream position (a position upstream of a recording unit) of the conveying path. The inkjet recording unit then records an image on the other side of the inverted recording sheet, and the sheet is later discharged.

The image recording apparatus described in JP-A-2001-83747 is configured to leave a recording sheet alone in a natural state on the inversion path, to thus be dried.

When a recording sheet soaked with ink droplets is dried, a curl occurs on the recording sheet, which is deformation of a sheet in the conveying direction.

In addition, the recording sheet immediately after performing the image recording is wet by the ink droplets. In order to prevent deterioration of the recorded image, one of the pair of discharge rollers is formed into the shape of a spur. However, the recording sheet wet from the ink droplets exhibits decreased stiffness and remains fragile. For this reason, a spur-shaped roller surface impresses the recording sheet, thereby leaving an imprint of the spur. The imprint of the spur left before drying of the recording sheet turns into a deformed knot, which would otherwise arise during drying of the recording sheet, whereby the number of crinkles increases.

In a case where the recording sheet with such crinkles or curl is inverted to record an image on the rear side of the sheet, when the recording sheet is again sent to the inkjet recording unit while a trailing end thereof is acting as a leading edge, the trailing end of the recording sheet may contact the inkjet recording unit, thereby causing a paper jam or blurring a recorded image.

SUMMARY

One aspect of the invention has an object to provide an image recording apparatus capable of preventing occurrence of a paper jam and recording clear images on both sides.

According to an aspect of the invention, there is provided an image recording apparatus comprising: a conveying path on which a recording medium is allowed to be conveyed in a conveying direction; a recording unit disposed in the conveying path and configured to perform an image recording operation to record an image on the recording medium by ejecting ink droplets, the recording medium having a first end and a second end opposite to the first end with respect to the conveying direction; a first roller pair disposed downstream of the recording unit with respect to the conveying direction and configured to send the recording medium downstream in the conveying direction while nipping the recording medium; a second roller pair disposed downstream of the first roller pair with respect to the conveying direction and configured to send the recording medium downstream in the conveying direction while nipping the recording medium; an inversion guide portion that connects a downstream portion of the conveying path positioned downstream of the recording unit to an upstream portion of the conveying path positioned upstream of the recording unit; a path changeover unit disposed at the downstream portion and configured to send the recording medium conveyed from the recording unit with the first end as a leading end to the inversion guide portion with the second end as a leading end; and a control unit configured to perform a stop operation to stop rotation of the first roller pair and the second roller pair thereby stopping a conveyance of the recording medium in a state where the first roller pair nips a vicinity of the second end of the recording medium and the second roller pair also nips the recording medium.

According to another aspect of the invention, there is provided an image recording apparatus comprising: a conveying path on which a recording medium is allowed to be conveyed in a conveying direction, the recording medium having a first end and a second end opposite to the first end with respect to the conveying direction; a recording unit disposed in the conveying path and configured to perform an image recording operation to record an image on the recording medium by ejecting ink droplets; a spur disposed in the conveying path and downstream of the recording unit with respect to the conveying direction; an inversion guide portion that connects a downstream portion positioned at the conveying path downstream of the recording unit to an upstream portion positioned at the conveying path upstream of the recording unit; a path changeover unit disposed at the downstream portion and configured to send the recording medium conveyed from the recording unit with the first end as a leading end to the inversion guide portion with the second end as a leading end; and a control unit configured to control a conveying velocity of the recording medium, wherein the control unit is configured to perform a deceleration operation in which the conveying velocity is decelerated after the image recording operation for a front side of the recording medium is completed and before the second end passes by the spur, wherein the control unit controls the conveying velocity to convey the recording medium at a second conveying velocity after the second end has passed by the spur, and wherein, in the deceleration operation, the control unit controls the conveying velocity to convey the recording medium at a first conveying velocity lower than the second conveying velocity.

According to still another aspect of the invention, there is provided an image recording apparatus comprising: a conveying path on which a recording medium is allowed to be conveyed in a conveying direction, the recording medium having a first end and a second end opposite to the first end with respect to the conveying direction; a recording unit disposed in the conveying path and configured to perform an image recording operation to record an image on the recording medium by ejecting ink droplets; a spur disposed in the conveying path and downstream of the recording unit with respect to the conveying direction; an inversion guide portion that connects a downstream portion positioned at the conveying path downstream of the recording unit to an upstream portion positioned at the conveying path upstream of the recording unit; a path changeover unit disposed at the downstream portion and configured to send the recording medium conveyed from the recording unit with the first end as a leading end to the inversion guide portion with the second end as a leading end; and a control unit configured to control a conveying velocity of the recording medium, wherein the control unit is configured to perform a deceleration operation in which the conveying velocity is decelerated such that ink adhering to the recording medium is dried after the image recording operation for a front side of the recording medium is completed and before the second end passes by the spur.

DESCRIPTION

The illustrative embodiments of the invention will be described in detail with reference to drawings, as appropriate. The embodiments simply show examples and can be changed appropriately within a scope of the present invention.

1. Overall Configuration of the Embodiments

Figure 1:
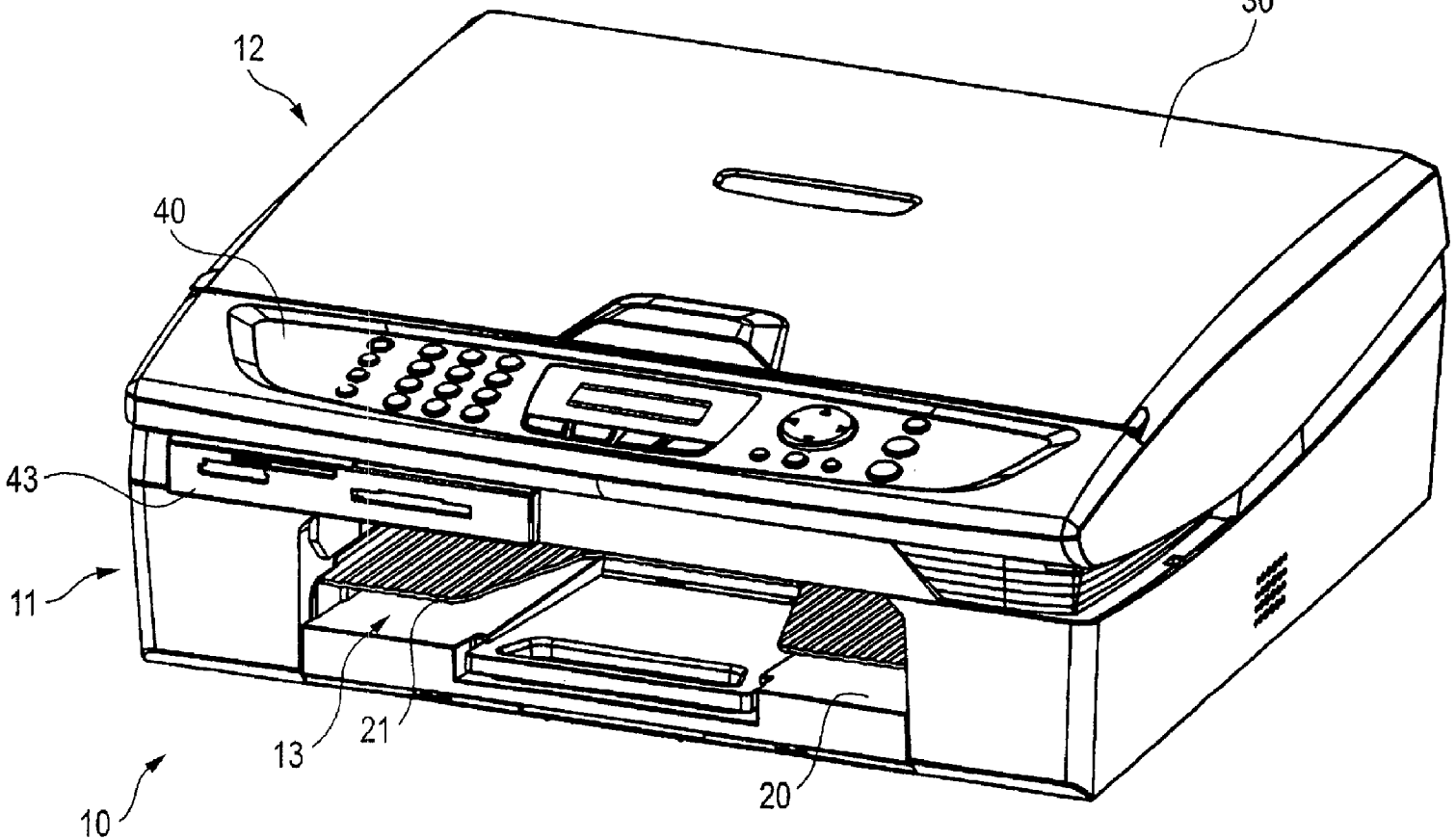
FIG. 1 is an external perspective view of a multi function device of embodiments of the present invention.
Figure 2:
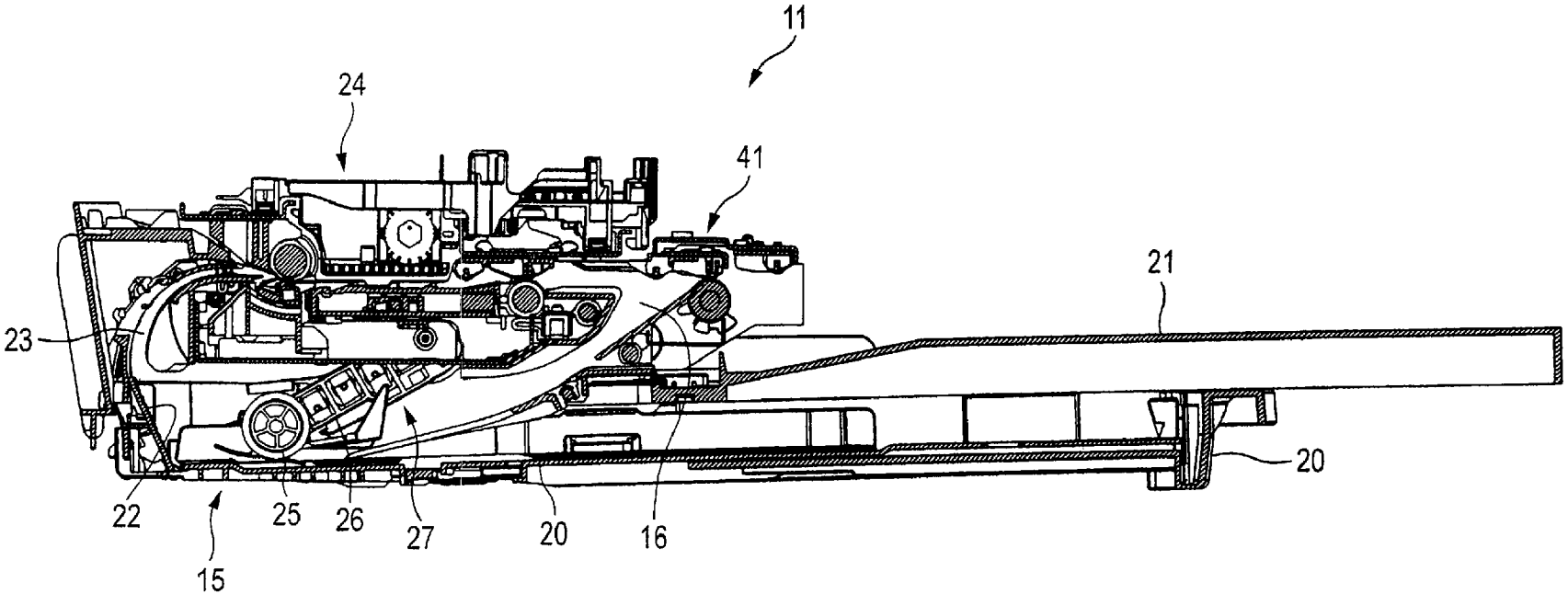
FIG. 2 is a longitudinal cross-sectional view of the multi function device of the embodiments of the present invention.
Figure 3:
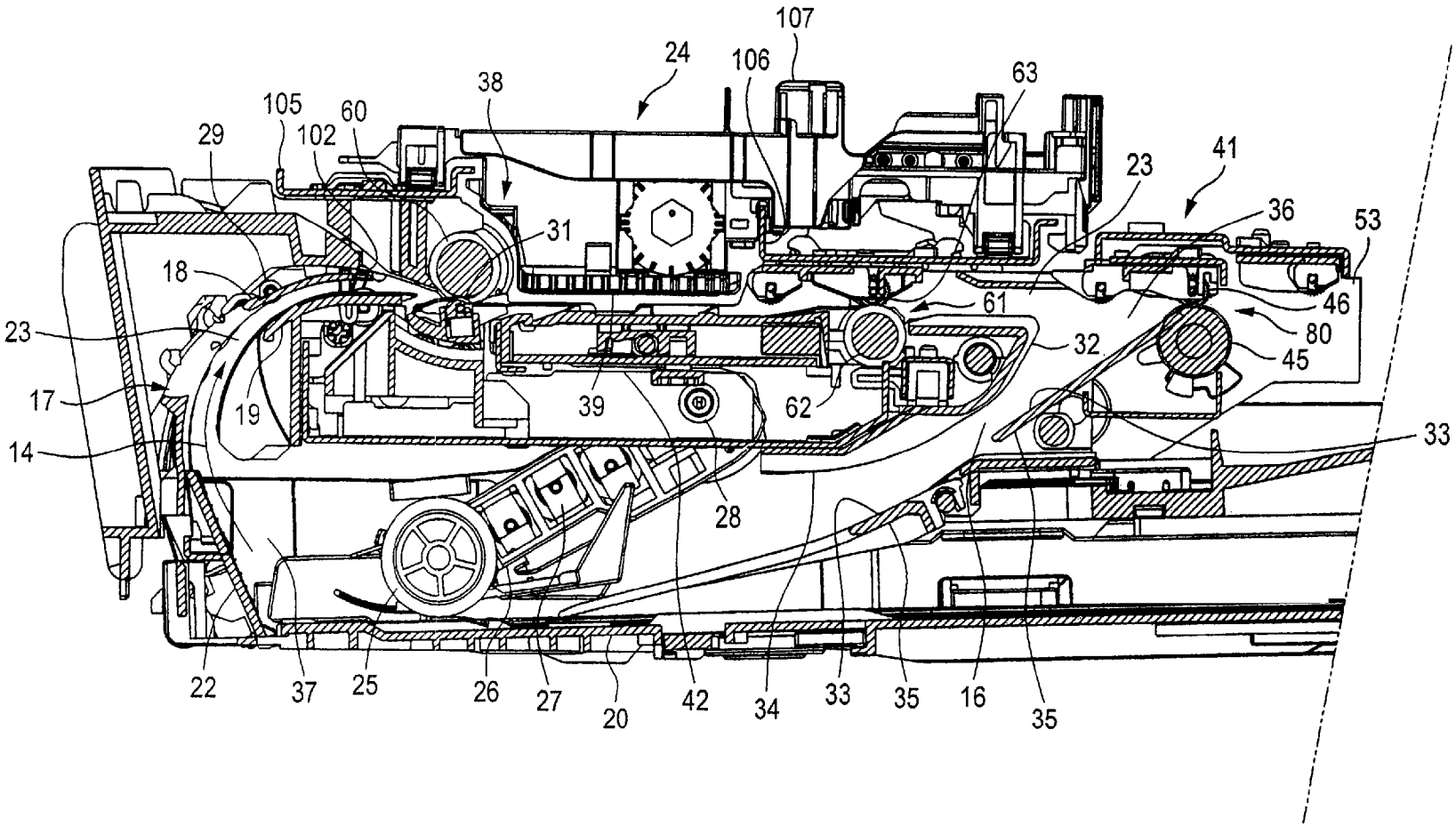
FIG. 3 is a partially-enlarged cross-sectional view of the multi function device of the embodiments of the present invention.

FIG. 1 is an external perspective view of a multi function device 10 of embodiments of the present invention. FIG. 2 is a longitudinal cross-sectional view showing the structure of a printer unit 11 of the multi function device 10. FIG. 3 is a partially-enlarged cross-sectional view of the printer unit 11.

The multi function device (MFD) 10 includes the printer unit 11 and a scanner unit 12 and has a printer function, a scanner function, a copier function, and a facsimile function. An image recording apparatus of the present invention is implemented as the printer unit 11 of the multi function device 10. Consequently, the functions of the multi function device 10 except the printer function are arbitrary.

As shown in FIG. 1, a lower portion of the multi function device 10 corresponds to the printer unit 11. As shown in FIG. 2, a conveying path 23 and an inversion guide portion 16 are formed in the printer unit 11. A recording sheet serving as a recording medium is conveyed along the conveying path 23. The printer unit 11 includes a feeding unit 15 for feeding a recording sheet to the conveying path 23; a recording unit 24 for recording an image by ejecting ink droplets on the recording sheet; a first roller pair 61 for conveying the recording sheet toward downstream side in the conveying direction; and a sheet discharging tray 21. The recording sheet is nipped by a conveying roller 60, a pinch roller 31, a discharge roller 62, and a spur roller 63 (see FIG. 3) and conveyed to a downstream position (i.e., a position in a rightward direction of FIG. 3) with respect to the conveying direction. The recording sheet is also nipped by a first roller 45 and a second roller 46 and sent toward the sheet discharging tray 21.

The multi function device 10 can record images on both sides of the recording sheet. When an image is to be recorded on a rear side of the recording sheet, as well, the recording sheet with an image recorded on a front side thereof is returned from the conveying path 23 to the inversion guide portion 16. Specifically, the recording sheet is guided to the inversion guide portion 16 by means of a path changeover unit 41 (specifically, a second roller pair 80 including the first roller 45 and the second roller 46; see FIG. 4) and is again sent to the conveying path 23 and turned inside out. The recording unit 24 records an image on the rear side of the inverted recording sheet.

In the multi function device 10 of a first embodiment (described later), the recording sheet with an image recorded on its front side is conveyed by following procedures described later. Namely, a recording sheet is sent downstream with respect to the conveying direction after an image is recorded on the front side of the recording sheet, and the recording sheet is stopped and dried while being nipped by means of a first roller pair 61 and a second roller pair 80 and is pulled in the conveying direction. Specifically, after completion of recording of an image on the front side of the recording sheet, a control unit 84 to be described later stops rotation of the first roller pair 61 and the second roller pair 80. The recorded recording sheet is discharged to the sheet discharging tray 21. The sheet discharging tray 21 is contiguous to a downstream side of the conveying path 23 with respect to the conveying direction.

In the multi function device 10 of a second embodiment (described later), the recording sheet with an image recorded on one side thereof is conveyed through procedures described later. Specifically, the recording sheet is conveyed such that ink is dried since an image is recorded on the front side until the recording sheet passes by the spur roller 63. In short, a control unit 84 described later controls conveyance of the recording sheet to decelerate the conveying velocity between the finish of recording an image finishes on the front surface of the recording sheet to the pass of the recording sheet through the spur roller 63.

As shown in FIG. 1, an upper portion of the multi function device 10 corresponds to the scanner unit 12. The scanner unit 12 is configured as a so-called flatbed scanner. A document cover 30 is provided as a top plate of the multi function device 10. Although unillustrated, platen glass is disposed beneath the document cover 30. A document can be put on the platen glass and read as an image while being covered with the document cover 30.

An operation panel 40 serving as a mode setting receiving unit is provided in a front upper portion of the multi function device 10. The operation panel 40 is a device for operating the printer unit 11 and the scanner unit 12 and includes various operation buttons and a liquid-crystal display unit. The multi function device 10 operates in accordance with an operation command from the operation panel 40. For instance, the operation panel 40 allows the user to selectively set the following modes: a single-sided recording mode for recording an image only on one side of a recording sheet; and a double-sided recording mode for recording images on both sides of a recording sheet. The operation panel also allows the user to set a resolution (a document mode or a photograph mode). When the multi function device 10 is connected to an external computer, the multi function device 10 is also operable in response to a command transmitted from the computer by way of a printer driver or a scanner driver. In this case, the printer driver or the scanner driver can serve as an example of a mode setting receiving unit. The multi function device 10 further includes a slot unit 43. Various memory devices such as compact memory cards serving as an example of storage media can be inserted into the slot unit 43. For instance, as a result of the user operating the operation panel 40 while a compact memory card is inserted in the slot unit 43, data such as image data stored in the compact memory card are read and recorded on a recording sheet.

2. Printer Unit

The internal configuration of the multi function device 10; particularly the configuration of the printer unit 11, will be described hereunder.

(2-1 Feeding Unit)

As shown in FIG. 1, an opening 13 is formed in the front of the printer unit 11. A sheet feeding tray 20 and the sheet discharging tray 21 are provided in two layers within the opening 13. As shown in FIG. 2, the feeding unit 15 includes the sheet feeding tray 20, a sheet feeding arm 26 and a sheet feeding roller 25, and a power transmission mechanism 27 for driving the sheet feeding roller 25.

The sheet feeding tray 20 stores recording sheets. The recording sheets stored in the sheet feeding tray 20 are fed to the inside of the printer unit 11. The sheet feeding tray 20 is disposed on the bottom side of the printer unit 11. A separation tilt plate 22 is provided at a deep position of the sheet feeding tray 20. The separation tilt plate 22 is contiguous with the conveying path 23. The separation tilt plate 22 separates recording sheets sent in an overlaid manner from the sheet feeding tray 20 and upwardly guides the top recording sheet. The conveying path 23 extends upwardly from the separation tilt plate 22 and is then curved to the front in the shape of the letter U. The conveying path 23 extends from the back (the left side in FIG. 2) of the multi function device 10 to the front (the right side in FIG. 2) and comes into mutual communication with the sheet discharging tray 21 by way of the recording unit 24. Consequently, the recording sheet stored in the sheet feeding tray 20 is guided from down to up along the sheet conveying path 23 so as to make a U-turn; reaches the recording unit 24 and undergoes image recording performed by the recording unit 24; and is discharged to the sheet discharging tray 21.

As shown in FIG. 3, the sheet feeding roller 25 is disposed at an upper portion of the sheet feeding tray 20. The sheet feeding roller 25 feeds the recording sheet placed on the sheet feeding tray 20 to the conveying path 23. The sheet feeding roller 25 is pivotally supported by the leading edge of the sheet feeding arm 26. The sheet feeding roller 25 is rotationally driven by means of an LF motor 71 (see FIG. 12), which is not shown in FIG. 3 and which is taken as a drive source, by way of the power transmission mechanism 27. The power transmission mechanism 27 includes a plurality of gears and is configured as a result of engagement of the gears.

The sheet feeding arm 26 is supported by a base axis 28. A base end portion of the sheet feeding arm 26 is supported by the base axis 28, and the sheet feeding arm 26 can rotate while taking the base axis 28 as a rotational center. Therefore, the sheet feeding arm 26 can ascend or descend so as to be able to contact or depart from the sheet feeding tray 20. The sheet feeding arm 26 is urged under its own weight or by means of a spring, or the like, to thus become pivotally urged in a downward direction. Therefore, the sheet feeding arm 26 usually contacts the sheet feeding tray 20 and is arranged so as to recede upwardly at the time of removal of the sheet feeding tray 20. As a result of the sheet feeding arm 26 being rotationally urged in the downward direction, the sheet feeding roller 25 comes into press-contact with the recording sheet on the sheet feeding tray 20. When the sheet feeding roller 25 is rotated in that state, the top recording sheet is fed toward the separation tilt plate 22 by means of frictional force developing between a roller surface of the sheet feeding roller 25 and the recording sheet. When the leading edge of the recording sheet contacts the separation tilt plate 22, the recording sheet is guided upwardly and sent to the conveying path 23 along an arrow 14. When the top recording sheet is fed by the sheet feeding roller 25, a recording sheet (second recording sheet) located immediately below the top recording sheet may be fed along with the top recording sheet by means of friction or static electricity. However, the second recording sheet is prevented from being fed by contacting with the separation tilt plate 22.

The conveying path 23 is partitioned into an outer guide surface and an inner guide surface except an area where the recording unit 24 or the like is disposed. For instance, a curved portion 17 of the conveying path 23 on the back of the multi function device 10 is formed by an outer guide member 18 and an inner guide member 19 being fixed to a frame of the recording apparatus. In this case, the outer guide member 18 forms the outer guide surface, and the inner guide member 19 forms the inner guide surface. The outer guide member 18 and the inner guide member 19 are disposed opposite each other while being spaced with a predetermined interval from each other. A roller 29 is disposed at a location where the conveying path 23 is curved. The roller 29 is freely rotatable. A roller surface of the roller 29 is exposed through the outer guide surface. Consequently, the recording sheet is smoothly conveyed even at a location where the conveying path 23 is curved.

(2-2 Recording Unit)

As illustrated, the recording unit 24 is placed in the conveying path 23. The recording unit 24 includes a carriage 38 and an inkjet recording head 39. The inkjet recording head 39 is mounted on the carriage 38. The carriage 38 moves back and forth with respect to a main scanning direction (a direction perpendicular to a drawing sheet of FIG. 3) along guide rails 105 and 106. Specifically, the carriage 38 is slidable by means of a CR motor 95 (see FIG. 12), which serves as a drive source, by way of, for example, a belt drive mechanism. An ink cartridge is provided in the multi function device 10 independently of the inkjet recording head 39. Any ink cartridge is not shown in FIG. 3. Ink is supplied from the ink cartridge to the inkjet recording head 39 by way of an ink tube. During reciprocal movement of the carriage 38, ink is ejected as minute ink droplets from the inkjet recording head 39, whereby an image is recorded on a recording sheet conveyed over a platen 42.

Although not shown, a linear encoder 85 (see FIG. 12) is provided on a body frame 53 of the multi function device 10. The linear encoder 85 detects the position of the carriage 38. An encoder strip of the linear encoder 85 is laid on each of the guide rails 105 and 106. Each of the encoder strips includes a transmissive portion for permitting transmission of light and a light-shielding portion for blocking light. The transmissive portion and the light-shielding portion are alternately provided at a predetermined pitch on each encoder strip in its longitudinal direction, thereby forming a predetermined pattern. Moreover, an optical sensor 107 serving as a transmissive sensor is provided on an upper surface of the carriage 38. The optical sensor 107 is placed at positions corresponding to the encoder strips. The optical sensor 107 reciprocally moves along the longitudinal direction of the encoder strips along with the carriage 38. During reciprocal movement, the optical sensor 107 detects the pattern of each of the encoder strips.

The recording unit 24 includes a head control substrate for controlling ejection of ink. The head control substrate outputs a pulse signal based on the pattern of each of the encoder strips detected by the optical sensor 107. The position of the carriage 38 is determined in accordance with the pulse signal, whereby reciprocal movement of the carriage 38 is controlled.

Figure 12:
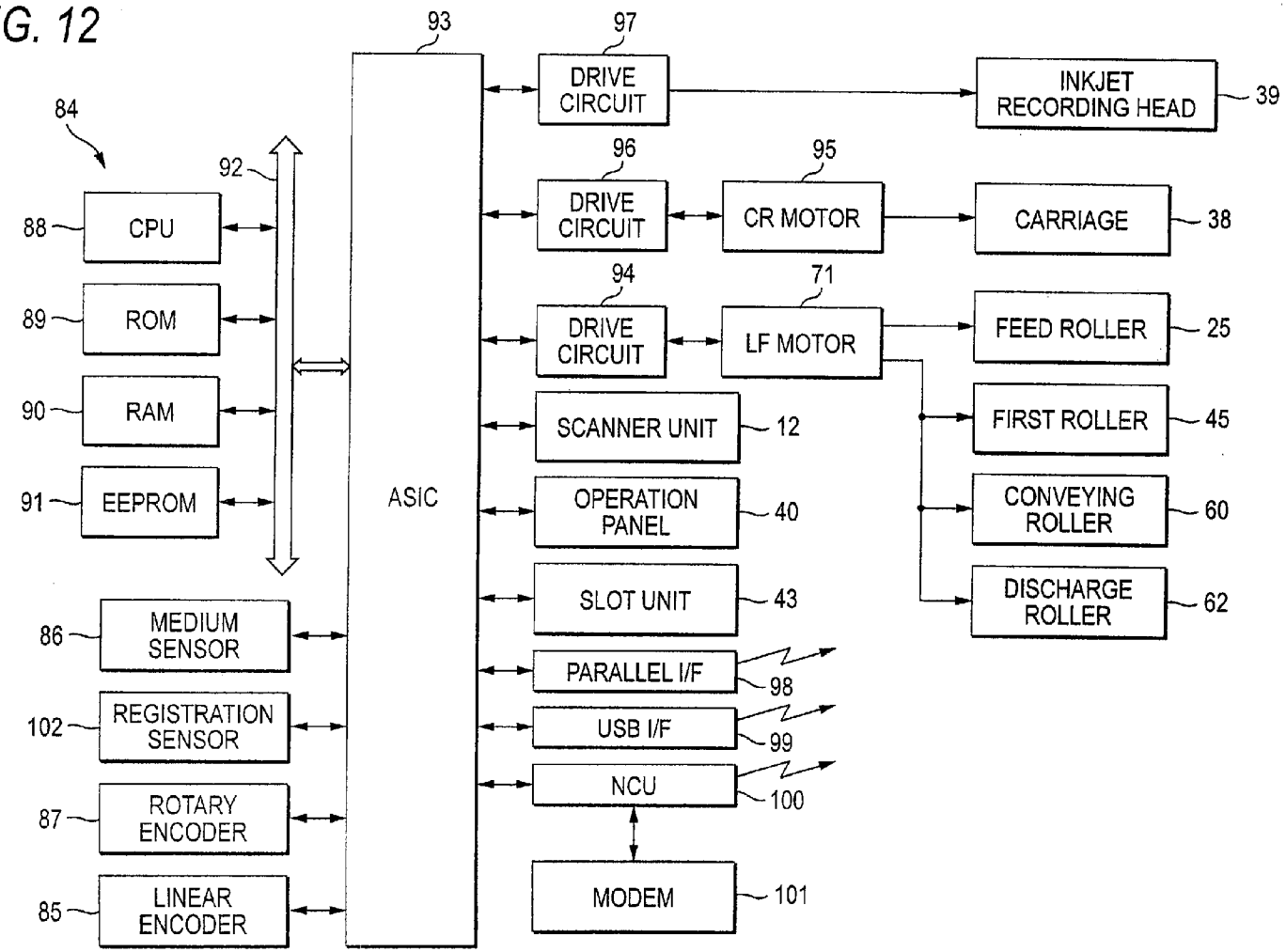
FIG. 12 is a block diagram showing the configuration of a control unit of the multi function device of the embodiments of the present invention.

Although not shown in FIG. 3, the carriage 38 has a medium sensor 86 (see FIG. 12). The medium sensor 86 detects presence/absence of a recording sheet on the platen 42. The medium sensor 86 includes a light source and a light-receiving element. The light source can emit light downwardly. The light emitted from the light source is radiated on a recording sheet conveyed over the platen 42. When the recording sheet has not yet conveyed to a position above the platen 42, the light is radiated on the platen 42. The light radiated on the recording sheet or the platen 42 is reflected. The light-receiving element receives the reflected light and produces an output conforming to the amount of received light. The output value is expressed by a so-called AD value (a voltage value). As a result of the carriage 42 being slid as mentioned previously, the medium sensor 86 scans the platen 42. The control unit 84 detects presence of the recording sheet on the platen 42 in accordance with a change in AD value.

(2-3 Inversion Guide Portion)

As shown in FIG. 3, the inversion guide portion 16 is connected to the conveying path 23. The inversion guide portion 16 is contiguous with a downstream portion (an example of a first portion) 36 of the conveying path 23 with respect to the recording unit 24. The inversion guide portion 16 constitutes an inversion path for again guiding onto the sheet feeding tray 20 a recording sheet with an image recorded on one side (surface) thereof. The inversion path is partitioned into a first guide surface 32 and a second guide surface 33. In the embodiments, the first guide surface 32 is formed from a surface of a guide member 34 disposed in the body frame 53 of the multi function device 10, and the second guide surface 33 is formed from a surface of a guide member 35 disposed in the body frame 53 of the multi function device 10. The guide members 34 and 35 are disposed opposite each other while being separated from each other by a predetermined interval. The first guide surface 32 and the second guide surface 33 extend obliquely in a downward direction from the downstream portion 36 of the conveying path 23 toward the sheet feeding roller 25.

Therefore, when the double-sided recording mode is set in the multi function device 10, the recording sheet with an image recorded on the surface thereof is again sent to an upstream portion 37 (an example of a second portion) of the conveying path 23 by means of the sheet feeding roller 25. The recording sheet is conveyed in the shape of the letter U along the direction of an arrow 14, as mentioned previously, whereby an image is recorded on the other surface (a rear side) by means of the recording unit 24. In the embodiments, the inversion guide portion 16 is configured so as to return the recording sheet onto the sheet feeding tray 20 but is not limited to such a configuration. In short, the inversion guide portion 16 may connect the downstream portion 36 of the conveying path 23 to the upstream portion 37. Consequently, the recording sheet may be returned to a position closer to the sheet feeding tray 20 rather than to the upstream portion 37.

(2-4 Sheet Conveying System)

As shown in FIG. 3, the conveying roller 60 and the pinch roller 31 are provided at an upstream side of the conveying path 23 with respect to the recording unit 24. The rollers 60 and 31 pair up with each other, and the pinch roller 31 is disposed so as to come into press-contact with a lower side of the conveying roller 60. The conveying roller 60 and the pinch roller 31 send the recording sheet conveyed on the conveying path 23 onto the platen 42 while nipping the recording sheet. The first roller pair 61 including the discharge roller 62 (serving as a first drive roller) and the spur roller 63 (serving as a first driven roller) are disposed on a downstream side of the conveying path 23 with respect to the recording unit 24. These rollers form a pair of discharge rollers for discharging a recording sheet to the sheet discharging tray 21, and the discharge roller 62 and the spur roller 63 convey the recorded sheet toward a further downstream side (toward the sheet discharging tray 21) in the conveying direction with respect to the conveying path 23 while nipping the recording sheet.

The conveying roller 60 and the discharge roller 62 are driven while the LF motor 71 is taken as a drive source. Driving of the conveying roller 60 and driving of the discharge roller 62 are synchronized with each other and are intermittently driven during recording of an image. As a result, a recording sheet is subjected to image recording while being sent at a predetermined carriage return width. Although unillustrated in the drawing, the conveying roller 60 is provided with the rotary encoder 87 (see FIG. 12). The rotary encoder 87 detects, by use of an optical sensor, a pattern of an encoder disk (not shown) that rotates along with the conveying roller 60. In accordance with a detection signal, rotation of the conveying roller 60 and rotation of the discharge roller 62 are controlled, and the conveying roller 60 and the discharge roller 62 are continually driven before and after image recording operation.

Figure 16:
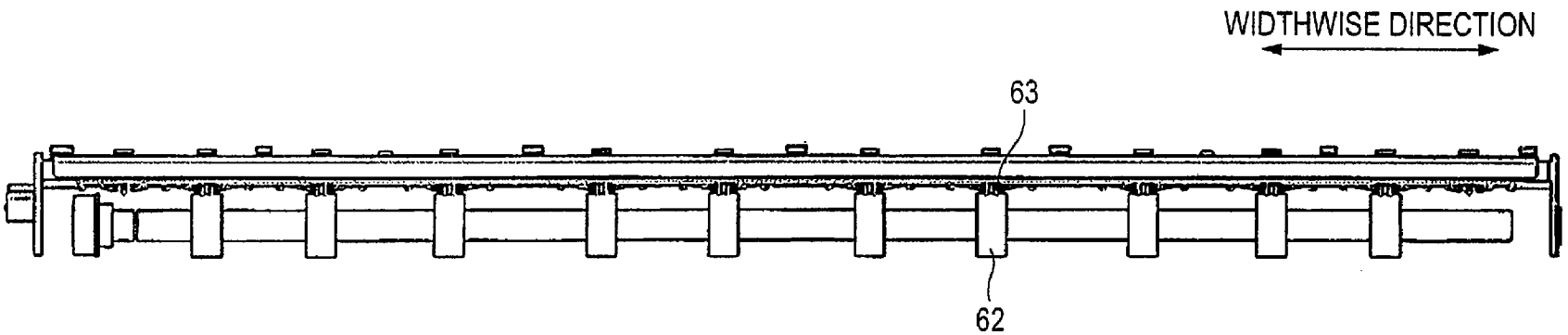
FIG. 16 is a side view of a plurality of first roller pairs according to embodiments of the invention.

The spur roller 63 comes into press-contact with the recorded recording sheet. A roller surface of the spur roller 63 is made uneven in the shape of a spur so as not to deteriorate an image recorded on the recording sheet. The spur roller 63 is provided to slidably move in a direction to contact or depart from the discharge roller 62. The spur roller 63 is urged so as to come into press-contact with the discharge roller 62. A coil spring is typically adopted as a unit for urging the spur roller 63 against the discharge roller. As shown in FIG. 16, a plurality of the first roller pairs 61, each of which includes the discharge roller 62 and the spur roller 63, are provided in the embodiments. The respective discharge rollers 62 and spur rollers 63 are arranged evenly side by side along a direction orthogonal to the conveying direction of a recording sheet;

namely, the widthwise direction of a recording sheet. The number of the first roller pairs 61 is set to ten in the embodiments, but the number of the first roller pairs 61 is not limited to ten and arbitrary number of the first roller pair(s) 61 may be provided.

When a recording sheet has entered between the discharge roller 62 and the spur roller 63, the spur roller 63 recedes to a distance equal to the thickness of the recording sheet in defiance of urging force of the coil spring. The recording sheet is brought into press-contact with the discharge roller 62, and torque of the discharge roller 62 is transmitted to the recording sheet without fail. Moreover, the pinch roller 31 is also elastically urged against to the conveying roller 60 in the same manner. Consequently, the recording sheet is brought into press-contact with the conveying roller 60, rotational force of the conveying roller 60 is transmitted to the recording sheet without fail.

A registration sensor 102 is disposed upstream of the conveying roller 60 of the conveying path 23. The registration sensor 102 includes a probe and an optical sensor. The probe is disposed so as to traverse the conveying path 23 and can selectively protrude or be retracted from the conveying path 23. The probe is always elastically urged so as to protrude into the conveying path 23. As a result of the recording sheet conveyed over the conveying path 23 coming into contact with the probe, the probe is retracted from the conveying path 23. The optical sensor is turn on or off depending on a presence of the probe. Therefore, the position of the leading end or trailing end of the recording sheet in the conveying path 23 is detected by means of the probe being caused to appear or be retracted by the recording sheet.

In the multi function device 10, the LF motor 71 serves as a drive source for feeding a recording sheet from the sheet feeding tray 20 and also as a drive source for conveying a recording sheet situated on the platen 42 and discharging a recorded recording sheet to the sheet discharging tray 21. Specifically, the LF motor 71 drives the conveying roller 60, as well as driving the sheet feeding roller 25 by way of the drive transmission mechanism 27 as mentioned previously. Moreover, the LF motor 71 is arranged to drive the discharge roller 62 by way of a predetermined power transmission mechanism. The power transmission mechanism may also include, for example, a train of gears; or a timing belt or the like may also be used in the light of assembly space.

(2-5 Path Changeover Unit)

Figure 4:
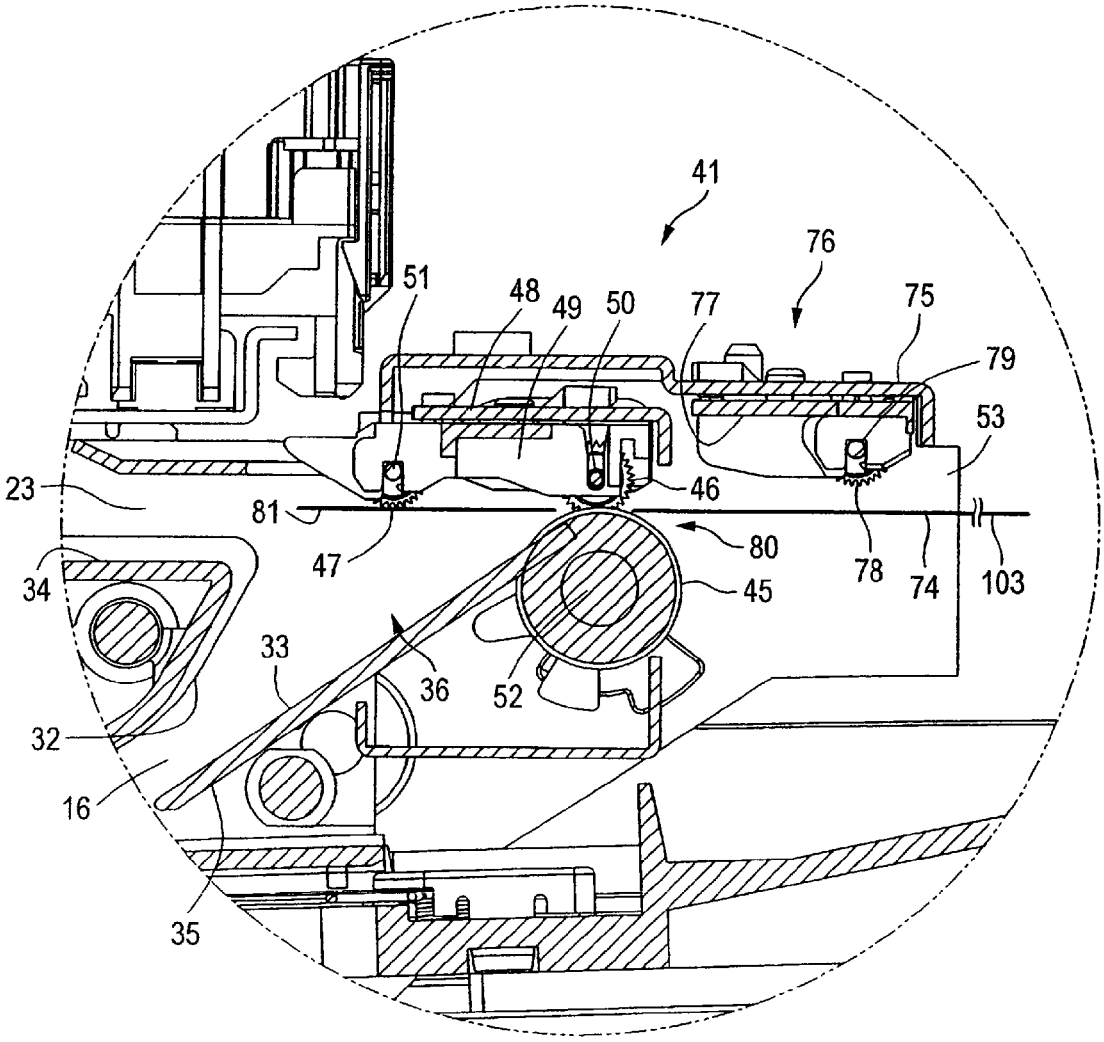
FIG. 4 is an enlarge view of the principal portion shown in FIG. 3.
Figure 5:
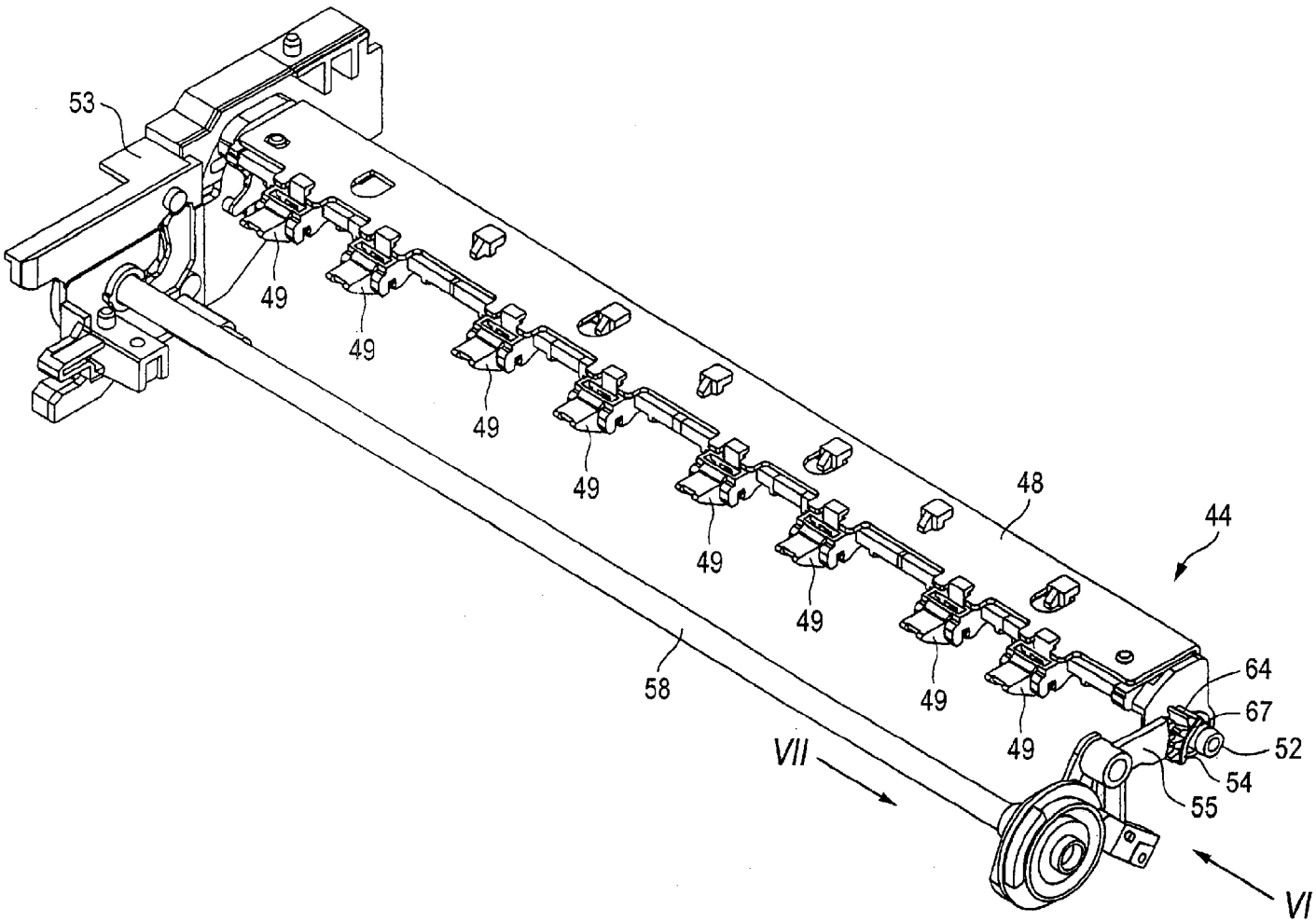
FIG. 5 is a perspective view of a drive mechanism of a path changeover unit according to the embodiments of the present invention.
Figure 6:
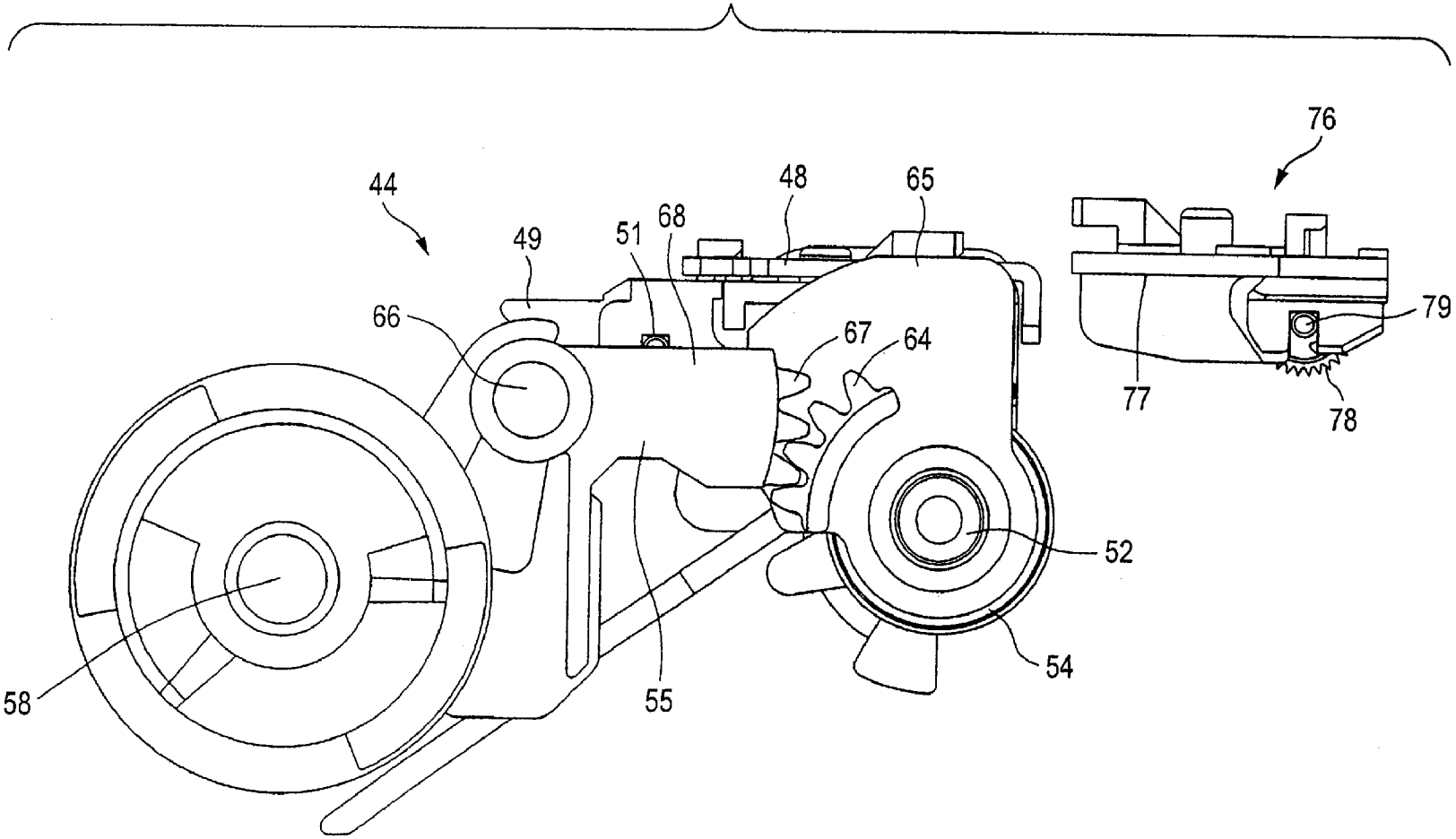
FIG. 6 is a side view of the drive mechanism when viewed in the direction of arrow VI shown in FIG. 5.
Figure 7:
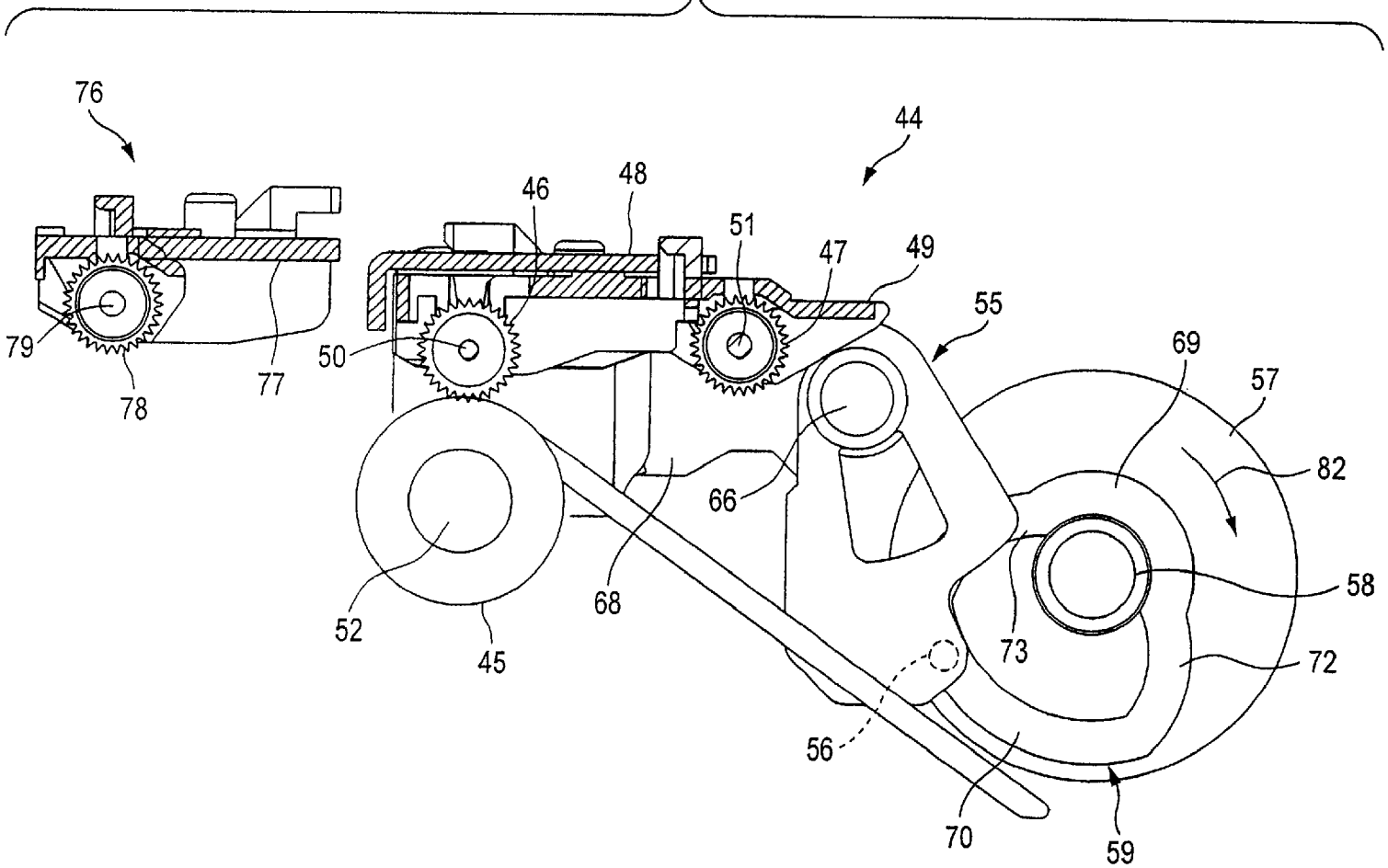
FIG. 7 is a partially-cross-sectional side view of the drive mechanism when viewed in the direction of arrow VII shown in FIG. 5.

FIG. 4 is an enlarge view of the principal unit shown in FIG. 3, showing in detail a cross-sectional structure of the path changeover unit 41. FIG. 5 is a perspective view of a drive mechanism 44 of the path changeover unit 41. FIG. 6 is a side view of the drive mechanism when viewed in the direction of arrow VI shown in FIG. 5, and FIG. 7 is a side view of the drive mechanism when viewed in the direction of arrow VII shown in FIG. 5.

As shown in FIGS. 3 and 4, the path changeover unit 41 is disposed at a position in the conveying path 23 which is downstream of the recording unit 24. Specifically, the path changeover unit 41 is positioned at the downstream portion 36 which is downstream of the recording unit 24; namely, a place that is in a boundary between the conveying path 23 and the inversion guide portion 16 and that is downstream in the conveying direction. The path changeover unit 41 includes a second roller pair 80 containing the first roller 45 (serving as a second drive roller) and the second roller 46 (serving as a second driven roller), and an auxiliary roller 47 disposed beside the second roller 46.

As will be described in detail later, the first roller 45 and the second roller 46 nip the recording sheet sent from the discharge roller 62 and the spur roller 63. The first roller 45 and the second roller 46 can convey the recording sheet further downstream in the conveying direction along the conveying path 23 (toward the sheet discharging tray 21) and return the recording sheet to the inversion guide portion 16.

The second roller 46 and the auxiliary roller 47 are attached to the frame 48. The frame 48 extends in a lateral direction of the multi function device 10 (in the direction perpendicular to the drawing sheet of FIG. 3). The frame 48 is formed into the substantially L-shape in cross section, as shown in FIG. 4. Thereby, bending stiffness of the frame 48 is ensured.

As shown in FIGS. 4 and 5, the frame 48 includes eight integrated sub-frames 49. The respective sub-frames 49 are arranged symmetrical in the lateral direction with respect to the center of the multi function device 10. Each of the sub-frames 49 has one second roller 46 and one auxiliary roller 47. Therefore, the frame 48 eventually includes eight second rollers 46 and eight auxiliary rollers 47. The respective second rollers 46 and the auxiliary rollers 47 are arranged with the same intervals side by side in the direction orthogonal to the conveying direction of the recording sheet; namely, in the widthwise direction of the recording sheet. As mentioned previously, the plurality of the first roller pairs 61 are also arranged with the same intervals side by side in the widthwise direction of the recording sheet, as shown in FIG. 16. Each of the spur rollers 63 is supported by means of a support structure analogous to that supporting the second roller 46.

The second roller 46 is supported by a support axis 50 provided in each of sub-frames 49 (see FIG. 4) so as to be rotatable around the support axis 50, and the auxiliary roller 47 is supported by a support axis 51 (see FIG. 4) provided in each sub-frame 49 so as to be rotatable around the support axis 51. In the embodiments, the second roller 46 and the auxiliary roller 47 are formed into the shape of a spur. The auxiliary roller 47 is disposed upstream of the second roller 46 in the conveying direction while being spaced apart from each other by a predetermined distance. The respective second rollers 46 are urged downwardly in FIG. 4 by means of unillustrated springs. Consequently, the respective second rollers 46 are always elastically pressed against the first roller 45.

The first roller 45 is rotated by means of taking the LF motor 71 as a drive source. Although unillustrated in the respective drawings, the first roller 45 is coupled to the LF motor 71 by way of a drive transmission mechanism. As shown in FIG. 5, the first roller 45 has a center axis 52. The center axis 52 is supported by the body frame 53 of the multi function device 10. The drive transmission mechanism is connected to the center axis 52. Brackets may also be provided on the center axis 52. As a result of the brackets being fastened to the body frame 53 by means of, for example, screws, the center axis 52 is reliably supported by the body frame 53.

The second rollers 46 are provided on the first roller 45. The first roller 45 may also be formed into a single elongated columnar shape, and the eight rollers may also be disposed opposite the respective second rollers 46. The first roller 45 is rotated forwardly and rearwardly by means of the LF motor 71. The recording sheet conveyed along the conveying path 23 is nipped between the first roller 45 and the second rollers 46. When the first roller 45 is forwardly rotated, the recording sheet is conveyed downstream in the conveying direction while being nipped between the first roller 45 and the second rollers 46 and discharged to the sheet discharging tray 21. In contrast, when the first roller 45 is rearwardly rotated, the recording sheet is returned upstream in the conveying direction while being nipped between the first roller 45 and the second rollers 46. In the embodiments, an outer diameter of the first roller 45 is slightly larger than the outer diameter of the discharge roller 62. Therefore, when the first roller 45 and the discharge roller 62 are driven at the same rotational speed (same angular velocity), the circumferential velocity of the first roller 45 is higher than the circumferential velocity of the discharge roller 62. Therefore, when the recording sheet is conveyed by means of the discharge roller 62 and the first roller 45, the recording sheet is always pulled in the conveying direction.

As shown in FIGS. 5 through 7, the drive mechanism 44 includes follower gears 54 provided around the center axis 52, drive gears 55 meshing with the respective follower gears 54; and cams 57 coupled to the respective drive gears 55 by way of pins 56. The cams 57 are illustrated only in FIG. 7. The cams 57 is provided with a rotational drive shaft 58, and the rotational drive shaft 58 is driven by means of taking the LF motor 71 as a drive source. As shown in FIG. 7, each of the cams 57 has a guide groove 59. The guide groove 59 is annularly formed around the rotational drive shaft 58. Each of the guide grooves 59 has a small circular-arc portion 69 and a large circular-arc portion 70, which are centered on the rotational drive shaft 58; a joint groove 72 for connecting one end of the small circular-arc portion 69 and one end of the large circular-arc portion 70 together; and a joint groove 73 for connecting the other end of the small circular-arc portion 69 and the other end of the large circular-arc portion 70 together. The pins 56 are fitted in the respective guide grooves 59 and slidably move along the guide grooves 59.

As shown in FIGS. 5 and 6, each of the follower gears 54 has a tooth portion 64 and a flange portion 65. The tooth portions 64 are configured as in the form of an involute gear centered on the center axis 52. The tooth portions 64 are fitted around the center axis 52 and can rotate around the center axis 52. The flange portions 65 are formed integrally with the tooth portions 64, to thus become connected to the frame 48. Therefore, when the tooth portions 64 are rotated, the frame 48, the sub-frames 49, the second rollers 46, and the auxiliary rollers 47 integrally rotate around the center axis 52.

The drive gears 55 are rotatably supported by a support axis 66. The support axis 66 is provided on the body frame 53. Each of the drive gears 55 has a tooth portion 67 and an arm 68. The pin 56 is protrudingly provided on each arm 68. The tooth portion 67 is configured in the form of an involute gear centered on the support axis 66 and meshes with the tooth portions 64. The tooth portions 64 rotate as a result of rotation of the tooth portion 67, and, consequently, the frame 48, the sub-frames 49, the second rollers 46, and the auxiliary rollers 47 rotate integrally around the center axis 52.

Figure 8:
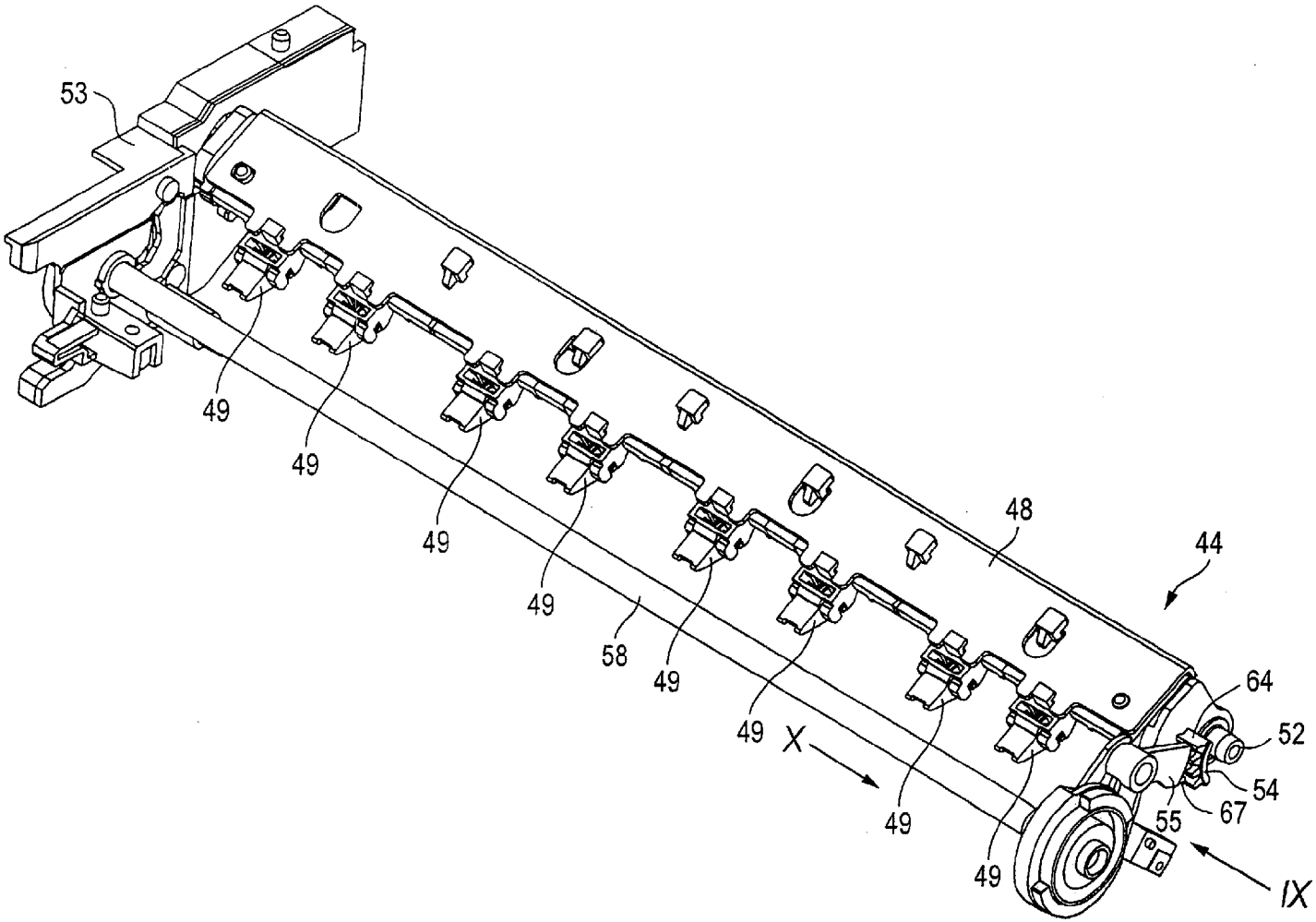
FIG. 8 is a perspective view of the drive mechanism of the path changeover unit according to the embodiments of the present invention.
Figure 9:
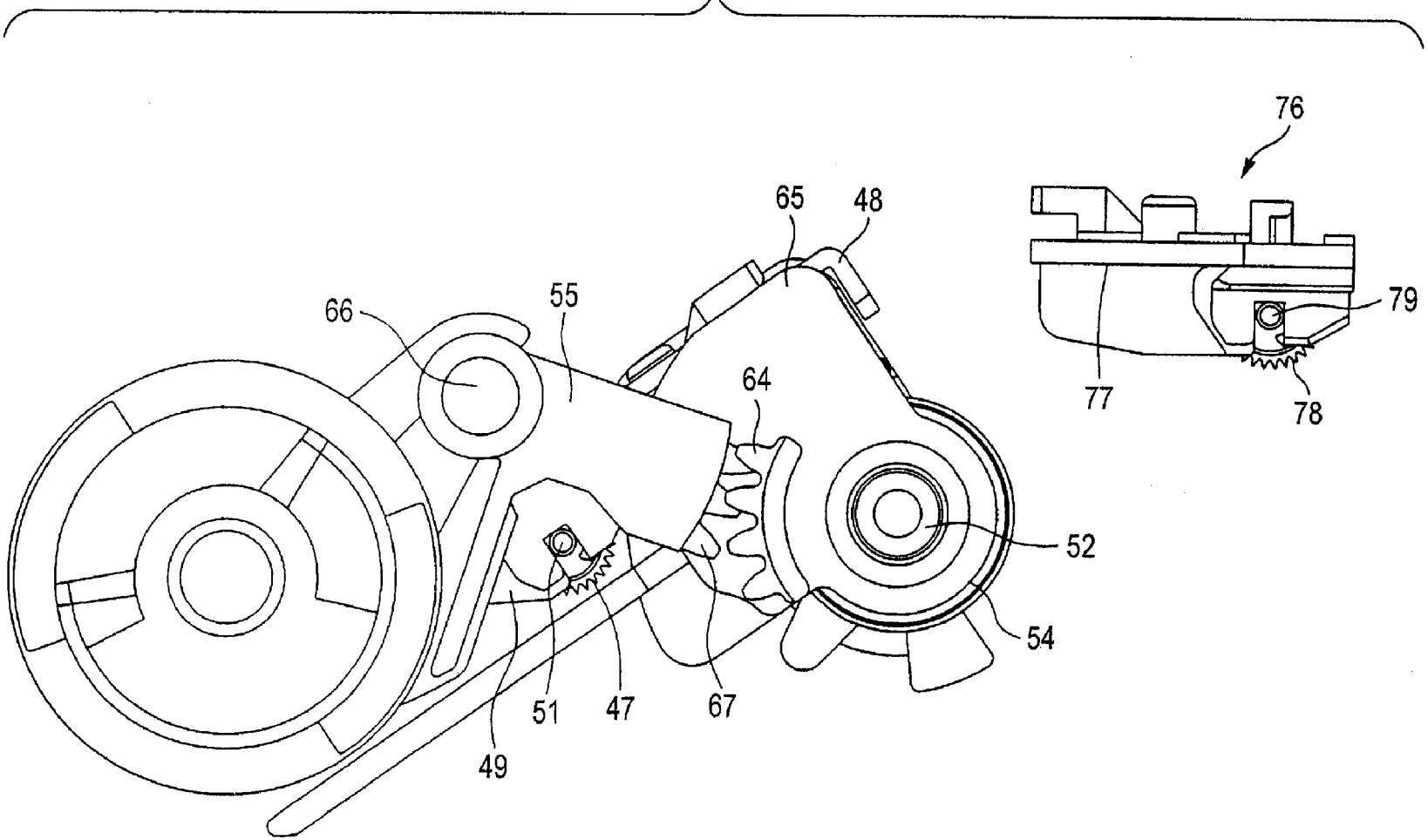
FIG. 9 is a side view of the drive mechanism when viewed in the direction of arrow IX shown in FIG. 8.
Figure 10:
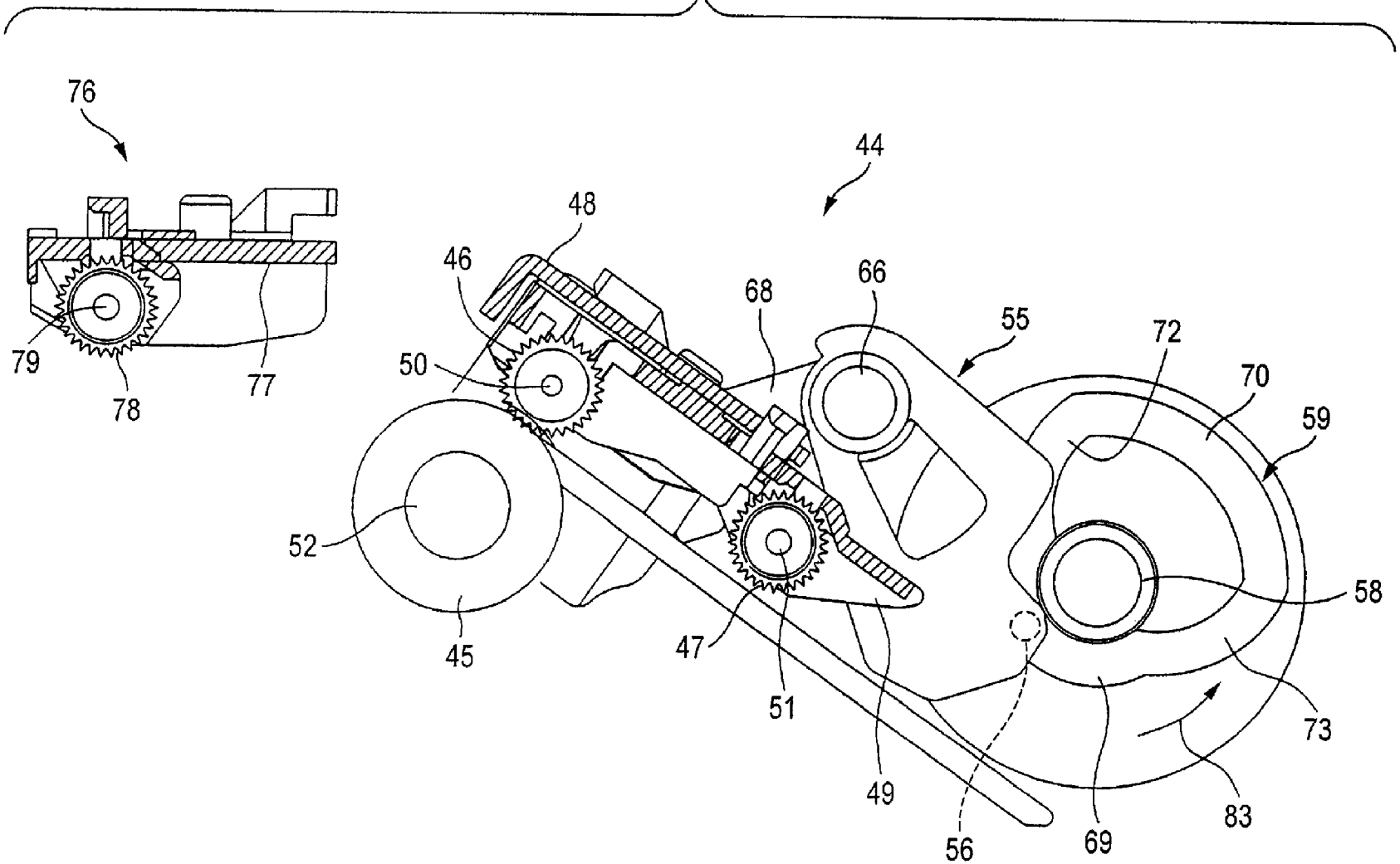
FIG. 10 is a partially-cross-sectional view of the drive mechanism when viewed in the direction of arrow X shown in FIG. 8.
Figure 11:
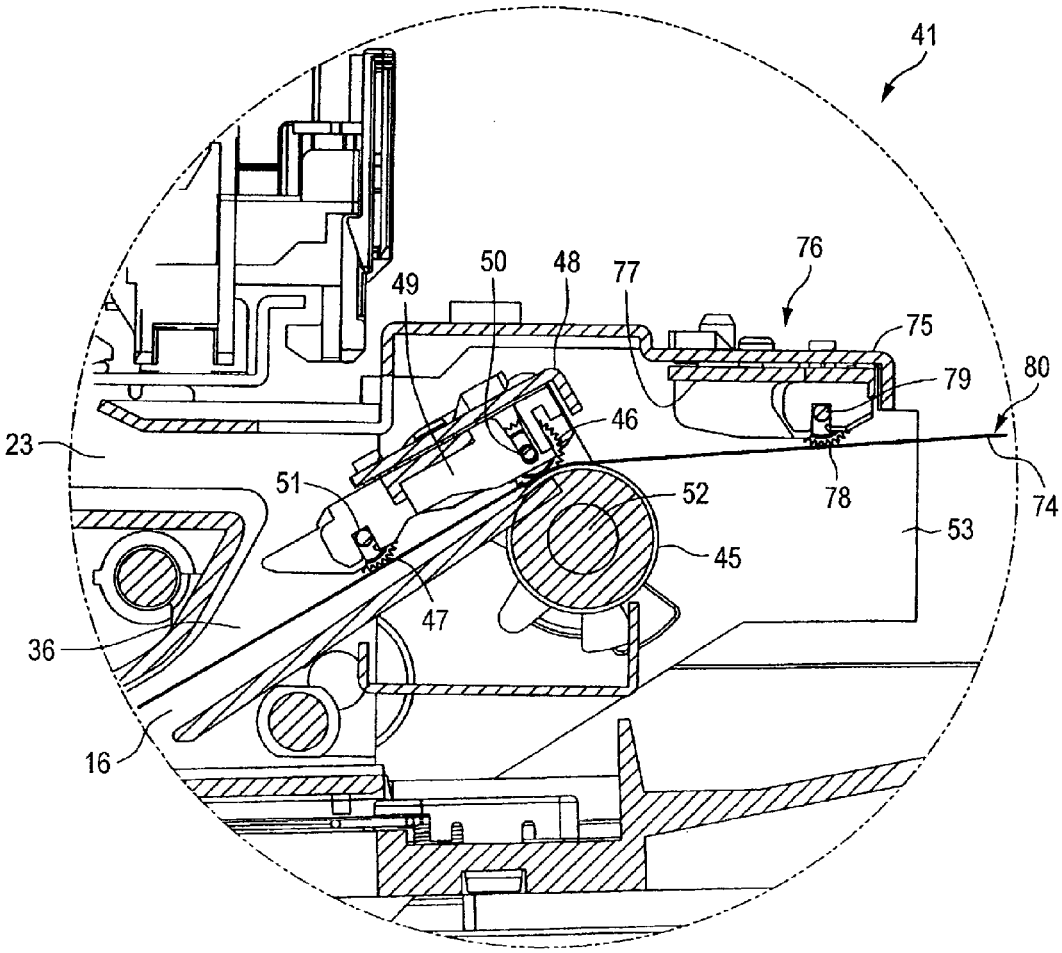
FIG. 11 is an enlarged view of the principal portion shown in FIG. 3.

FIG. 8 is a perspective view of the drive mechanism 44 of the path changeover unit 41 achieved when the frame 48, the sub-frames 49, the second rollers 46, and the auxiliary rollers 47 are rotated. FIG. 9 is a side view of the drive mechanism when viewed in the direction of arrow IX shown in FIG. 8, and FIG. 10 is a side view of the drive mechanism when viewed in the direction of arrow X shown in FIG. 8. FIG. 11 is an enlarged view of the principal portion shown in FIG. 3, showing a state where the path changeover unit 41 has rotated around the center axis 52.

As shown in FIG. 7, when the cams 57 are rotated, the pins 56 relatively move along the guide grooves 59. In particular, when the pins 56 slide along the joint grooves 72 and 73, the pins 56 move in a radial direction of the cams 57. Therefore, when the cams 57 are rotated clockwise (in the direction of an arrow 82) in FIG. 7, each of the pins 56 moves in sequence of the large circular-arc portion 70, the joint groove 72, and the small circular-arc portion 69. As a result, the drive gears 55 are rotated clockwise in FIG. 6. Consequently, the follower gears 54 rotate counterclockwise around the center axis 52 in FIG. 6. Since the follower gears 54 are coupled to the frame 48 as mentioned previously, the frame 48, the sub-frames 49, the second rollers 46, and the auxiliary rollers 47 are integrally rotated around the center axis 52 as a result of rotation of the follower gears 54, to thus enter states shown in FIGS. 8 to 10. When the cams 57 are rotated counterclockwise (in the direction of an arrow 83) in FIG. 10 from the states shown in FIGS. 8 through 10, the pins 56 move in sequence of the small circular-arc portions 69, the joint grooves 72, and the large circular-arc portions 70. Therefore, the drive gears 55 rotate counterclockwise in FIG. 9. As a result, the follower gears 54 rotate clockwise around the center axis 52 in FIG. 9.

At this time, the frame 48, the sub-frames 49, the second rollers 46, and the auxiliary rollers 47 are rotated around the center axis 52. Therefore, as shown in FIGS. 4 and 11, the second rollers 46 roll over a circumferential surface of the first roller 45. In the embodiments, the position of the path changeover unit 41, such as that shown in FIG. 4, is defined as a "recording medium discharge position." The position of the path changeover unit 41, such as that shown in FIG. 11, is defined as a "recording medium inversion position." When an image is recorded only on the front side of a recording sheet, the path changeover unit 41 is always positioned at the recording medium discharge position, and a recording sheet conveyed along the conveying path 23 is delivered to the sheet discharging tray 21 (see FIG. 4). When the path changeover unit 41 is positioned at the recording medium discharge position, a tangent line to the first roller 45 or the second roller 46 at a contact point of the first roller 45 and the second roller 46 extends along the conveying path.

When the path changeover unit 41 has changed to the recording medium inversion position, the recording sheet 74 is returned upstream in the conveying direction, as shown in FIG. 11, whereby the recording sheet is guided to the inversion guide portion 16. For example, when the path changeover unit 41 is positioned at the recording medium inversion position, a tangent line to the first roller 45 or the second roller 46 at a contact point of the first roller 45 and the second roller 46 extends along the inversion guide portion 16. Specifically, when images are recorded on both sides of the recording sheet, the path changeover unit 41 maintains the recording medium discharge position (see FIG. 4), and the recording sheet with an image recorded on the front side thereof is delivered downstream in the conveying direction. Subsequently, the path changeover unit 41 changes from the recording medium discharge position to the recording medium inversion position (see FIG. 11), and the auxiliary roller 47 guides the recording sheet 74 while holding the recording sheet 74 toward the inversion guide portion 16.

(2-6 Guide Unit)

As shown in FIGS. 4 and 11, the guide unit 76 is disposed downstream of the first roller 45 and the second rollers 46 in the conveying direction. A support plate 75 is attached to each of the body frame 53, and a guide unit 76 is provided on each of the support plates 75. The guide unit 76 includes a base portion 77 fixed to a lower surface of the support plate 75 and a guide roller 78 supported by the base portion 77. The base portion 77 includes a spindle 79, and the guide rollers 78 are rotatably supported by the spindle 79. In the embodiments, the guide rollers 78 are formed in the shape of a spur.

The guide unit 76 is disposed at a predetermined location. Specifically, the guide unit 76 comes into contact with a record surface of the recording sheet 74 when the recording sheet 74 is in the middle of being delivered to the inversion guide portion 16 as a result of rearward rotation of the first roller 45 and the second rollers 46. Further, when the first roller 45 and the second rollers 46 forwardly rotates, to thus send the recording sheet 74 to the sheet discharging tray 21, the guide unit 76 does not come into contact with the recording sheet 74. Specifically, the guide unit 76 is disposed at a position where the guide unit 76 does not contact an imaginary line interconnecting points of contact between the first roller 45 and the second rollers 46 and a point of contact between the discharge roller 62 and the spur roller 63.

As will be described later, the recording sheet 74 is delivered to the inversion guide portion 16 while the orientation of conveyance of the recording sheet is changed. The orientation of a portion of the recording sheet 74 located downstream with respect to the first roller 45 and the second rollers 46 is attempted to be changed to a direction parallel to the inversion guide portion 16 due to stiffness of the recording sheet 74. However, the guide rollers 78 come into contact with a record surface of the recording sheet 74, thereby bending the recording sheet 74. Therefore, the recording sheet 74 is wrapped around the first roller 45 and the second rollers 46, so that the recording sheet 74 is delivered to the inversion guide portion 16 without fail.

3. Control System

FIG. 12 is a block diagram showing the configuration of the control unit 84 of the multi function device 10.

The control unit 84 is configured to control the overall operation of the multi function device 10 that includes the scanner unit 12 as well as the printer unit 11. The control unit 84 includes a main substrate and disposed at a predetermined position within the body frame 53. A configuration for controlling the scanner unit 12 is not the principal portion of the present invention, and hence its detailed explanation is omitted.

As illustrated, the control unit 84 is configured as a microcomputer essentially including a CPU (Central Processing Unit) 88, ROM (Read Only Memory) 89, RAM (Random Access Memory) 90, and EEPROM (Electrically Erasable and Programmable ROM) 91. The control unit 84 is connected to an ASIC (Application-Specific Integrated Circuit) 93 by way of a bus 92.

Programs, or the like, for controlling various operations of the multi function device 10 are stored in the ROM 89. The RAM 90 is used as a storage area or a work area for temporarily storing various sets of data used when the CPU 88 executes the program. Settings, flags, and the like, which are to be stored even after power shutoff, are stored in the EEPROM 91.

In accordance with a command from the CPU 88, the ASIC 93 generates a phase excitation signal, or the like, for energizing the LF motor 71. The signal is supplied to the drive circuit 94 of the LF motor 71, and the drive signal applies power to the LF motor 71 by way of the drive circuit 94. Thus, rotation of the LF motor 71 is controlled.

The drive circuit 94 is configured to drive the LF motor 71 connected to the feed roller 45, the conveying roller 60, the discharge roller 52, and the first roller 45. Upon receipt of a signal output from the ASIC 93, the drive circuit 94 generates an electric signal for rotating the LF motor 71. Upon receipt of the electric signal, the LF motor 71 rotates. Torque of the LF motor 71 is transmitted to the feed roller 25, the conveying roller 60, the sheet discharging roller 65, and the first roller 45. The torque of the LF motor 71 is transmitted to the feed roller 25, or the like, by way of a drive mechanism including gears, drive axes, and the like. As mentioned above, in the multi function device 10 of the embodiments, the LF motor 71 serves as a drive source for feeding a recording sheet from the sheet feeding tray 20, conveying a recording sheet located on the platen 42, and discharging a recorded recording sheet to the sheet discharging tray 21.

In accordance with the command from the CPU 88, the ASIC 93 generates a phase excitation signal, or the like, for energizing the CR motor 95. The signal is supplied to a drive circuit 96 of the CR motor 95, and a drive signal is applied to the CR motor 95 by way of the drive circuit 96. Thus, rotation of the CR motor 95 is controlled.

The drive circuit 96 is configured to drive the CR motor 95. Upon receipt of a signal output from the ASIC 93, the drive circuit 96 generates an electric signal for rotating the CR motor 95. Upon receipt of the electric signal, the CR motor 95 rotates. Torque of the CR motor 95 is transmitted to the carriage 38 by way of a drive mechanism, whereby the carriage 38 reciprocally moves. Thus, the control unit 84 controls reciprocal movement of the carriage 38.

The drive circuit 97 is configured to drive the inkjet recording head 39 at predetermined timing. Following drive control procedures output from the CPU 88, the ASIC 93 generates an output signal. In accordance with the output signal, the drive circuit 97 drives and controls the inkjet recording head 39. The drive circuit 97 is mounted on a head control substrate. A signal output from the drive circuit 97 is transmitted from the main substrate constituting the control unit 84 to the head control substrate. As a result, the inkjet recording head 39 selectively ejects ink of respective colors on a recording sheet at predetermined timings.

The rotary encoder 87 for detecting the amount of rotation of the conveying roller 60, the linear encoder 85 for detecting the position of the carriage 38, the registration sensor 102 for detecting leading and trailing ends of the recording sheet 74, and the medium sensor 86 for detecting the presence of the recording sheet 74 on the platen 42 are connected to the ASIC 93. As a result of power of the multi function device 10 being turned on, the carriage 38 temporarily moves to a slide end thereof, whereupon the detect position of the linear encoder 85 is initialized. When the carriage 38 is slid from the initial position, the optical sensor 107 provided on the carriage 38 detects the pattern of the encoder strips. The control unit 84 ascertains the amount of movement of the carriage 38 in accordance with the number of pulse signals generated as a result of detection of the optical sensor 107. In order to control reciprocal movement of the carriage 38 in accordance with the amount of movement, the control unit 84 controls rotation of the CR motor 95. In accordance with a signal from the registration sensor 102 and the amount of encoding detected by the rotary encoder 87, the control unit 84 ascertains the position of the leading end or the trailing end of the recording sheet 74. When the leading end of the recording sheet has reached a predetermined position on the platen 42, the control unit 84 controls rotation of the LF motor 71 in order to intermittently convey a recording sheet at every predetermined carriage return width. The carriage return width is set in accordance with a resolution, or the like, input as a condition for recording an image. In particular, when high-resolution recording, specifically, recording of a borderless photograph, is performed, the control unit 84 accurately detects the leading and trailing ends of a recording sheet in accordance with presence of the recording sheet 74 detected by the medium sensor 86 and the amount of encoding detected by the rotary encoder 87. Moreover, the control unit 84 accurately detects positions of both ends of a recording sheet by means of presence of the recording sheet 74 detected by the medium sensor 86 and the amount of encoding detected by the linear encoder 85. In accordance with the thus-detected position of the leading or trailing end of the recording sheet 74 or the thus-detected positions of both the leading and trailing ends of the same, the control unit 84 controls ejection of ink droplets performed by the inkjet recording head 39.

The scanner unit 12, the operation panel 40 for setting an image recording mode and issuing other operation commands to the multi function device 10, the slot unit 43 into which various compact memory cards are inserted, the parallel interface 98 and the USB interface 79 for exchanging data with an external information device, such as a personal computer, through a parallel cable and a USB cable, and the like, can be connected to the ASIC 93. Further, an NCU (Network Control Unit) 100 and a modem 101 for implementing the facsimile function can also be connected to the ASIC 93.

First Embodiment

Figure 13:
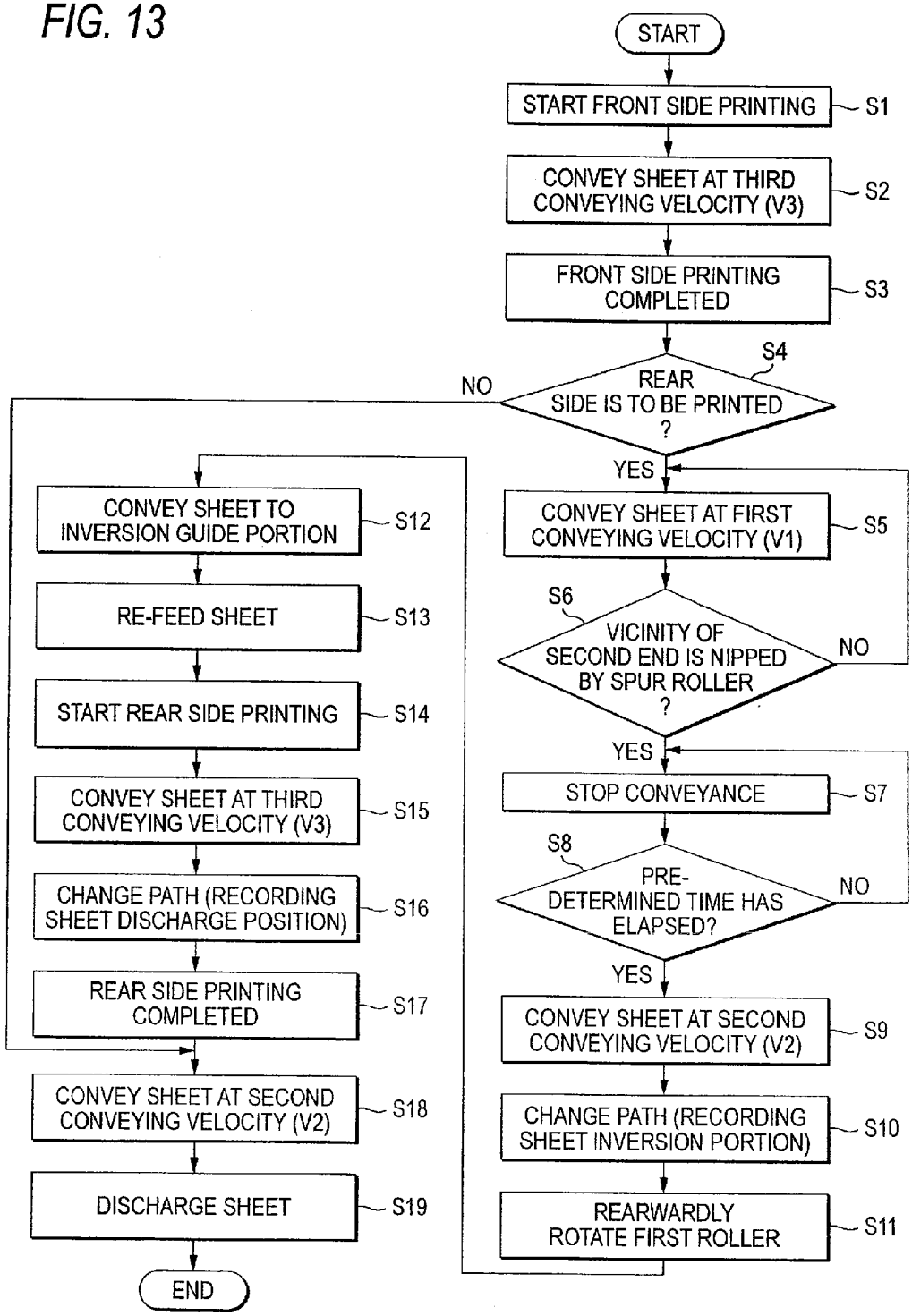
FIG. 13 is a flowchart showing procedures for conveying a recording sheet during image recording operation according to a first embodiment.

FIG. 13 is a flowchart showing procedures for conveying a recording sheet during image recording operation according to the first embodiment of the invention.

As shown in FIG. 3, the recording sheet 74 (see FIG. 4) fed from the sheet feeding tray 20 is conveyed along a direction of arrow 14. Specifically, the recording sheet 74 is conveyed while a first end 103 (see FIG. 4) thereof is taken as a leading end and a second end thereof 81 (see FIG. 4) is taken as a trailing end. The recording unit 24 records an image on the front side of the recording sheet 74 (step S1 in FIG. 12). The recording sheet 74 is delivered downstream over the platen 42 at third conveying velocity V3 in the conveying direction while being nipped by means of the conveying roller 60 and the pinch roller 31, the discharge roller 62 and the spur roller 63, and the first roller 45 and the second rollers 46 (step S2).

The third conveying velocity V3 is determined by the control unit 84. In this case, the recording sheet 74 is intermittently sent, and an image is recorded by means of the carriage 38 performing sliding operation in a state where the recording sheet 74 remains stationary. Intermittent feeding of the recording sheet 74 is implemented by means of the control unit 84 intermittently rotating the conveying roller 60, the pinch roller 31, the discharge roller 62, the spur roller 63, the first roller 45, and the second rollers 46. Specifically, when ink droplets are ejected from the inkjet recording head 39 while the carriage 38 is performing sliding operation, the recording sheet 74 is stopped. When ink droplets are not ejected from the inkjet recording head 39, the recording sheet 74 is fed at a predetermined carriage return width. Average speed of the intermittently-fed recording sheet 74 is set as the third conveying velocity V3.

Recording of an image on the surface of the recording sheet 74 is completed (step S3), the control unit 84 next determines whether or not the recording mode is set to a single-sided recording mode or a double-sided recording mode (step S4). The image recording mode is set by means of the user previously operating the operation panel 40 or the like. Data used for specifying a single-sided recording mode or a double-sided recording mode are transmitted from the operation panel 40 to the RAM 90 of the control unit 84, and the data are stored in the RAM 90. As a matter of course, data used for designating a single-sided recording mode may also be stored as a default value in the ROM 89 in advance. In response to the control unit 84 reading data used for specifying a double-sided recording mode from the RAM 90 or the ROM 89, an image is recorded on the rear side of the recording sheet 74.

When the single-sided recording mode is set by means of the user operating, for example, the operation panel 40 (see FIG. 1) (N in step S4), an image is recorded only on the front side of the recording sheet 74. As mentioned previously, when the single-sided recording mode is set, the path changeover unit 41 always assumes the recording sheet discharge position (see FIG. 4). The first roller 45 and the second rollers 46 rotate forwardly, whereby the recording sheet 74 is conveyed downstream in the conveying direction. At this time, the recording sheet 74 is conveyed at second conveying velocity V2 (step S17) and discharged to the sheet discharging tray 21 (step S18). Setting of the second conveying velocity V2 will be described later.

When the double-sided recording mode is set by means of the user operating, for example, the operation panel 40 (see FIG. 1) (Y in step S4), an image is recorded on the rear side of the recording sheet 74, as well. In this case, the recording sheet 74 is conveyed as follows. First, the path changeover unit 41 assumes the recording sheet discharge position (see FIG. 4), and the first roller 45 and the second rollers 46 rotate forwardly while nipping the recording sheet 74. As a result, the recording sheet 74 is conveyed to the sheet discharging tray 21.

The control unit 84 determines the position of the second end 81 of the recording sheet 74 on the basis of a value output from the rotary encoder 87 while taking, as a reference, a point in time when the registration sensor 102 is switched between ON and OFF. When so-called borderless recording is performed, the control unit 84 determines the position of the second end 81 of the recording sheet 74 in accordance with a value output from the medium sensor 86 and a value output from the rotary encoder. After recording of an image on the front side of the recording sheet 74 is completed, the recording sheet 74 is sent at the first conveying velocity V1 (step S5). The first conveying velocity V1 is determined by the control unit 84. The first conveying velocity V1 may be set to be lower than the third conveying velocity V3.

Next, it is determined whether or not the second end 81 of the recording sheet 74 conveyed at the first conveying velocity V1 has been nipped by the spur roller 63 (see FIG. 3) (step S6). When the second end 81 of the recording sheet 74 has not passed by the spur roller 63 (N in step S6), the recording sheet 74 is further conveyed at the first conveying velocity V1 (step S5).

After a vicinity of the second end 81 of the recording sheet 74 is nipped by the spur roller 63 (Y in step S6), conveyance of the recording sheet 74 is stopped (step S7). It is determined whether or not stopped state of the recording sheet 74 has continued after elapse of a predetermined period of time (step S8). When the predetermined period of time has not elapsed in this state (N in step S8), stopped state of the recording sheet 74 is maintained (step S7). At this time, the recording sheet 74 is pulled in the conveying direction because of a difference between the outer diameter of the discharge roller 62 and the outer diameter of the first roller 45, and tensile force remains arisen in the conveying direction in the vicinity of the second end 81 of the recording sheet 74. Specifically, the neighborhood of the second end 81 of the recording sheet 74 remains pulled for a predetermined period of time.

When the stopped state of the recording sheet 74 has continued after elapse of the predetermined time (Y in step S8), the recording sheet 74 is sent at second conveying velocity V2 (step S9). Second conveying velocity V2 is determined by the control unit 84. The second conveying velocity V2 may also be set to be higher than the first conveying velocity V1.

In order to be changed to the recording medium inversion position, the path changeover unit 41 pivots around the support axis 50 of the first roller 45. Specifically, the second roller 46 rolls over the circumferential surface of the first roller 45 while nipping the recording sheet 74, whereupon the auxiliary roller 47 presses the recording sheet 74. In other words, the second rollers 46 rolls over the circumferential surface of the first roller 45 so as to wrap the recording sheet 74 around the circumferential surface of the first roller 45. As a result, the orientation of the recording sheet 74 is readily changed toward the inversion guide portion 16.

The recording sheet 74 sent to the inversion guide portion 16 is sent to the conveying path 23 by means of the feed roller 25 (step S13) and again sent to the recording unit 24. At this time, the recording sheet 74 is sent while the second end 81 is taken as a leading end and the first end 103 is taken as a trailing end. Since the conveying path 23 is formed in the substantially U-shape in cross section as mentioned previously, the recording sheet 74 is turned inside out, and recording of an image on the rear side of the recording sheet is commenced (step S14). After recording of an image on the reverse is commenced, the recording sheet 74 is intermittently sent over the platen 42 at the third conveying velocity V3 as in recording of an image on the front side (step S15). Before the second end 81 of the recording sheet 74 enters the path changeover unit 41, the path changeover unit 41 again changes from the recording medium inversion position to the recording medium discharge position (step S16). Subsequently, recording of an image on the rear side of the recording sheet 74 is completed (step S17). The recording sheet 74 with images recorded on both sides thereof is nipped between the first roller 45 and the second rollers 46 of the path changeover unit 41 and sent downstream with respect to the direction of conveying. At this time, the first roller 45 and the second rollers 46 rotate forwardly, and the recording sheet 74 is conveyed at the second conveying velocity V2 (step S18) and discharged to the sheet discharging tray 21 (step S19).

According to the multi function device 10 of the first embodiment, the discharge roller 62 and the spur roller 63 nip the neighborhood of the second end 81 of the recording sheet 74, and rotation of the discharge roller 62 and the first roller 45 is stopped while the first roller 45 and the second roller 46 nip the recording sheet 74. At this time, the ink adhering to the surface of the recording sheet 74 is dried while the recording sheet 74 remains pulled in the conveying direction, so that occurrence of a curl, which would otherwise arise in the vicinity of the second end 81 at the time of drying of ink, is prevented. Consequently, when an image is recorded on the rear side of the recording sheet 74 as a result of the recording sheet having been turned inside out, the recording sheet 74 is smoothly resent to the conveying path 23. As a result, when images are recorded on both sides, occurrence of a paper jam is prevented, and recording with high image quality is realized.

In the first embodiment, the plurality of discharge rollers 62 are arranged side by side along the widthwise direction of the recording sheet 74. Hence, tensile force remains arisen in the vicinity of the second end 81 of the recording sheet 74 in the direction orthogonal to the conveying direction, so that occurrence of crinkles, which would otherwise arise in the vicinity of the second end 81 of the recording sheet 74, is prevented. Therefore, when an image is recorded on the rear side of the recording sheet 74, the recording sheet 74 is resent to the conveying path 23 in a smoother manner, whereby occurrence of a paper jam is prevented.

In the first embodiment, only when the double-sided recording mode is set by way of the operation panel 40, rotation of the discharge roller 62 and the first roller 45 are stopped. Therefore, there is yielded an advantage of a time elapsing from when a sheet is fed until when recording is completed being not prolonged when an image is recorded only on a front side.

In addition, the time for stopping the discharge roller 62 and the first roller 45 is determined in consideration of various factors. For instance, the stop time can be changed according to whether or not resolution is set to a document mode or a photograph mode by way of the operation panel 40. When the resolution is set to the photography mode, the stop time becomes longer. Further, the stop time can be set according to the type of the recording sheet 74. For instance, when a photographic print sheet is adopted in lieu of a plain sheet, the stop time becomes longer when compared with that adopted for a plain sheet. The type of a recording sheet can be determined in accordance with information from a printer driver. Moreover, the stop time can also be changed according to the amount of ink ejected from the inkjet recording head 39 (e.g., the amount of ink ejected per path). The greater the amount of ink, the longer is set the stop time. The amount of ink is determined based on data output from a head control substrate. The stop time can also be changed according to ambient temperature and humidity of the recording sheet 74 achieved during recording of an image. In this case, a temperature sensor and a humidity sensor are provided at predetermined positions within the body frame 53, and the control unit 84 determines the stop time on the basis of temperature data and humidity data. As higher temperature and humidity are achieved in the environment, the stop time is set so as to become longer.

When the second end 81 of the recording sheet 74 has reached the auxiliary roller 47 (see FIG. 4), the path changeover unit 41 assumes the recording medium inversion position (step S10). As a result, the second end 81 of the recording sheet 74 is pressed by the auxiliary roller 47 and oriented toward the inversion guide portion 16 (see FIG. 11). Subsequently, as a result of the first roller 45 and the second rollers 46 being rotated reversely (step S11), the recording sheet 74 is sent to the inversion guide portion 16 (step S12). At this time, the recording sheet 74 enters the inversion guide portion 16 while taking the second end 81 as a leading end.

Second Embodiment

Figure 14:
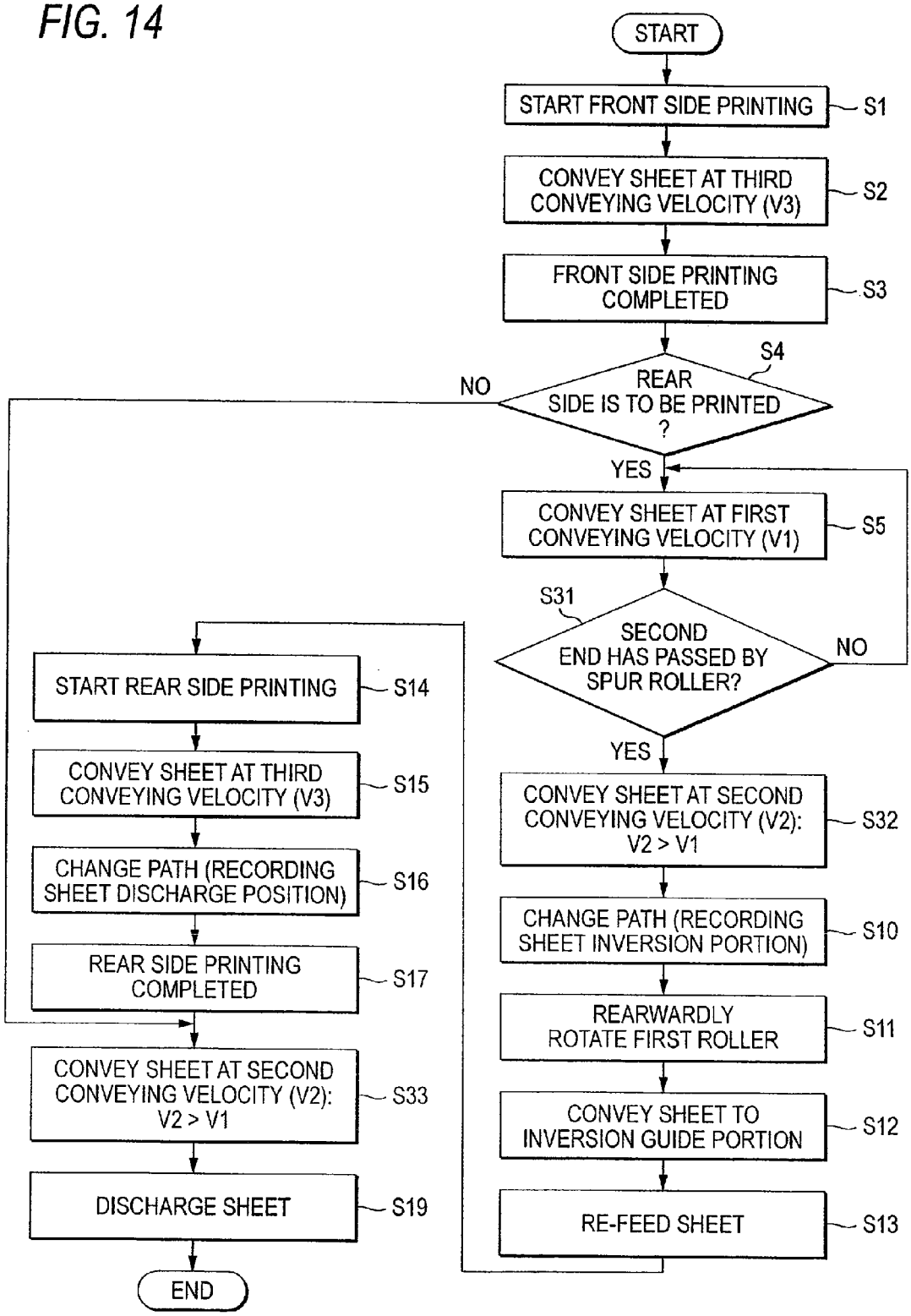
FIG. 14 is a flowchart showing procedures for conveying a recording sheet during image recording operation according to a second embodiment.

FIG. 14 is a flowchart showing procedures for conveying a recording sheet during image recording operation according to the second embodiment of the invention. The same reference symbols are referred to the same or similar steps in the processes shown in FIGS. 13 and 14, and description thereof is omitted.

After the image recording operation for the front side of the recording sheet 74 is completed (step S3) and when the double-sided printing is selected (Y in S4), the recording sheet 74 is conveyed at a first conveying velocity (V1).

Next, it is determined whether or not the second end 81 of the recording sheet 74 fed at the first conveying velocity V1 has passed by the spur roller 63 (see FIG. 3) (step S32). When the second end 81 of the recording sheet 74 has not passed by the spur roller 63 (N in step S32), the recording sheet 74 is further fed at the first conveying velocity V1.

After the second end 81 of the recording sheet 74 has passed by the spur roller 63 (Y in step S32), the recording sheet 74 is sent at the second conveying velocity V2 (step S33). In the second embodiment, the second conveying velocity V2 is set so as to become higher than the first conveying velocity V1. After recording of an image on the surface of the recording sheet 74 has been completed, the recording sheet 74 is sent at the first conveying velocity V1 until the second end 81 passes by the spur roller 63, and hence a predetermined period of time elapses until the second end 81 of the recording sheet 74 passes by the spur roller 63. This predetermined period of time is set to a time sufficient for drying ink droplets adhering to the recording sheet 74. The second conveying velocity V2 is also determined by the control unit 84.

Thereafter, steps S10 to S16 are performed, and then the image recording for the rear side of the recording sheet 74 is completed (step S17). After the rear side recording is completed (step S17) or when the single-sided recording mode is selected (N in step S4), the recording sheet 74 is nipped between the first roller 45 and the second rollers 46 of the path changeover unit 41 and sent downstream with respect to the direction of conveying. At this time, the first roller 45 and the second rollers 46 rotate forwardly, and the recording sheet 74 is conveyed at the second conveying velocity V2 that is higher than the first conveying velocity V1 (step S33) and discharged to the sheet discharging tray 21 (step S19).

According to the multi function device 10 of the second embodiment, the first conveying velocity V1, for conveying the recording sheet 74 before the second end 81 of the recording sheet 74 passes by the spur roller 63 after completion of recording of an image on the front side of the recording sheet 74, is set so as to become lower than the second conveying velocity V2 for conveying the recording sheet 74 after the second end 81 has passed by the spur roller 63. Specifically, the recording sheet 74 with an image recorded on the front side thereof is slowly conveyed until the second end 81 passes by the spur roller 63. Therefore, ink droplets are sufficiently dried until the recording sheet 74 with the image recorded on the front side thereof passes by the spur roller 63. Therefore, formation of an imprint of the spur in the vicinity of the second end 81 of the recording sheet 74 is inhibited, and occurrence of crinkles in the vicinity of the second end 81 is prevented.

Consequently, in the multi function device 10, when the recording sheet 74 with an image recorded on the front side thereof is inverted and when an image is also recorded on the rear side of the recording sheet 74, occurrence of crinkles in the vicinity of the second end 81 is prevented, whereby occurrence of a paper jam is prevented and high-quality recording of an image on a rear surface is enabled.

In the second embodiment, during recording of an image performed by the inkjet recording head 39, the recording sheet 74 is conveyed at the third conveying velocity V3. The control unit 84 decelerates and controls the conveyance of the recording sheet 74 such that the first conveying velocity V1 becomes lower than the third conveying velocity V3. As a result, there is yielded an advantage of ink droplets being sufficiently dried until the recording sheet 74 with an image recorded on the front side thereof passes by the spur roller 63.

In the second embodiment, the second conveying velocity V2 is set so as to become higher than the third conveying velocity V3. Such second conveying velocity V2 is determined by the control unit 84. As a result, a time elapsing before the recording sheet 74 is discharged to the sheet discharging tray 21 after passing the spur roller 63 is shortened. In short, there is yielded an advantage of a total amount of time elapsing from when a sheet is fed until when recording ends being shortened.

Moreover, the recording mode can be set by means of the user operating the operation panel 40. The control unit 84 may also be configured to control conveyance of the recording sheet 74 such that the first conveying velocity V1 becomes lower than the second conveying velocity V2 only when a double-sided recording mode is set. Specifically, when a single-sided recording mode is set, the recording sheet 74 is sent to the sheet discharging tray 21 at the second conveying velocity V2 after an image has been recorded on the front side of the recording sheet 74 (step S13 and step S14). Therefore, when an image is recorded only on the front side of the recording sheet 74, there is yielded an advantage of a time elapsing from when a sheet is fed until when recording ends being not prolonged.

Modifications of the Second Embodiment

Next, a modification of the second embodiment will be described.

Figure 15:
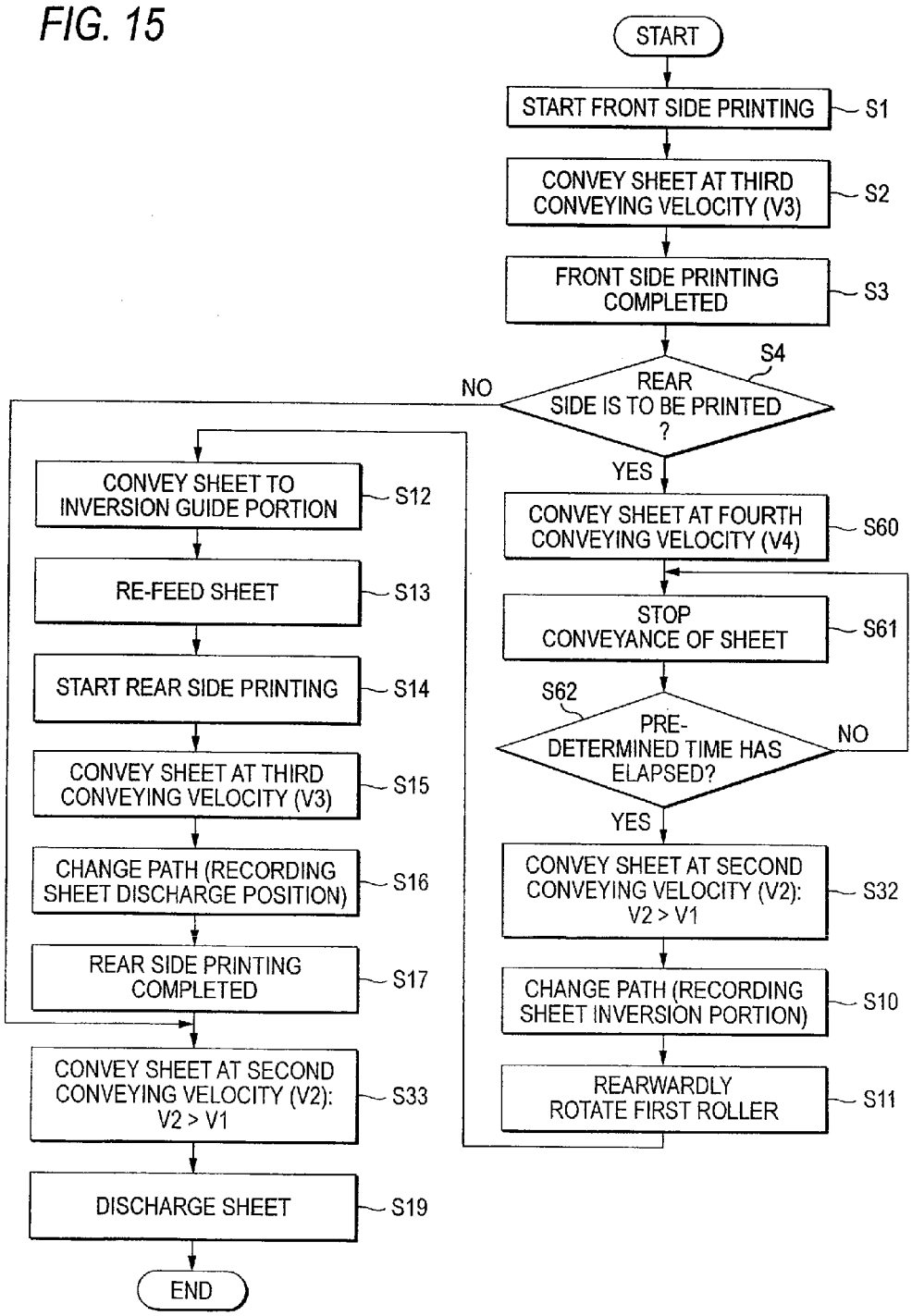
FIG. 15 is a flowchart showing procedures for conveying a recording sheet at the time of recording of an image in a modification of the second embodiment.

FIG. 15 is a flowchart showing procedures for conveying a recording sheet at the time of recording of an image in the modification of the second embodiment.

A difference between the procedures for conveying a recording sheet in the modification and the procedures for conveying a recording sheet of the second embodiment is as follows. In the second embodiment, the first conveying velocity V1 is set so as to become lower than the second conveying velocity V2 such that the ink adhering to the recording sheet 74 is dried before the second end 81 of the recording sheet 74 passes by the spur roller 63 after completion of recording of an image on the front side of the recording sheet 74. In contrast, in the modification, the recording sheet 74 is temporarily stopped for a predetermined period of time such that ink is sufficiently dried (step S61 and step S62). In other respects, the modification is analogous to the second embodiment in terms of configuration.

When an image is recorded on a rear side of the recording sheet 74 with the image recorded on the front side thereof as in the second embodiment (Y in step S4), the recording sheet 74 is temporarily sent downstream in the conveying direction at a fourth conveying velocity V4 (step S60). The fourth conveying velocity V4 is determined by the control unit 84. When the second end 81 of the recording sheet 74 is in an area located before arrival of the second end 81 at the spur roller 63, conveyance of the recording sheet 74 is stopped. Specifically, the control unit 84 stops the first roller 45 and the second rollers 46 (step S61).

In the modification, the recording sheet 74 with the image recorded on the front side thereof is temporarily stopped after being conveyed at the fourth conveying velocity V4, and further passes by the spur roller 63 subsequently. Average velocity achieved before the second end 81 of the recording sheet 74 passes by the spur roller 63 after an image being recorded on the front side of the recording sheet 74 corresponds to the first conveying velocity V1 of the second embodiment.

As a result, ink droplets are sufficiently dried before the recording sheet 74 with the image recorded on the front side thereof passes by the spur roller 63.

In the second embodiment and the modification thereof, the first conveying velocity V1 (or the fourth conveying velocity V4 and/or the temporary stop time) can be determined on the basis of various factors. For instance, the first conveying velocity V1 and the stop time can be changed according to whether resolution is set to the document mode or the photo mode by means of the operation panel 40. In the case of the photo mode, the first conveying velocity V1 is set so as to become lower, and the stop time is set so as to become much longer. Moreover, the first conveying velocity V1 and the stop time can be set according to the type of the recording sheet 74. For example, in the case of a photographic print sheet rather than in the case of a plain sheet, the first conveying velocity V1 is set so as to become lower, and the stop time is made much longer. The type of the recording sheet can be determined in accordance with information sent from a printer driver. Further, the first conveying velocity V1 and the stop time can be set even by means of the amount of ink ejected from the inkjet recording head 39 (e.g., the amount of ink ejected per path). The greater the amount of ink, the lower is set the first conveying velocity V1, and the longer is set the stop time. The amount of ink is determined based on data output from the head control substrate. Moreover, the first conveying velocity V1 and the stop time can be altered according to an ambient temperature and ambient humidity of the recording sheet 74 achieved during formation of an image. In this case, a temperature sensor and a humidity sensor are provided at predetermined positions within the body frame 53, and the control unit 84 determines the stop time on the basis of temperature data and humidity data. As higher temperature and humidity are achieved in the environment, the first conveying velocity V1 is set so as to become lower, and the stop time becomes longer.

What is claimed is:

1. An image recording apparatus comprising:

a conveying path on which a recording medium is allowed to be conveyed in a conveying direction;

a recording unit disposed in the conveying path and configured to perform an image recording operation to record an image on the recording medium by ejecting ink droplets, the recording medium having a first end and a second end opposite to the first end with respect to the conveying direction;

a first roller pair disposed downstream of the recording unit with respect to the conveying direction and configured to send the recording medium downstream in the conveying direction while nipping the recording medium;

a second roller pair disposed downstream of the first roller pair with respect to the conveying direction and configured to send the recording medium downstream in the conveying direction while nipping the recording medium;

an inversion guide portion that connects a downstream portion of the conveying path positioned downstream of the recording unit to an upstream portion of the conveying path positioned upstream of the recording unit;

a path changeover unit disposed at the downstream portion and configured to send the recording medium conveyed from the recording unit with the first end as a leading end to the inversion guide portion with the second end as a leading end; and a control unit configured to perform a stop operation to stop rotation of the first roller pair and the second roller pair thereby stopping a conveyance of the recording medium in a state where the first roller pair nips a vicinity of the second end of the recording medium and the second roller pair also nips the recording medium.

2. The image recording apparatus according to claim 1, wherein a plurality of the first roller pairs are disposed along a direction perpendicular to the conveying direction with respect to a recording surface of the recording medium.

3. The image recording apparatus according to claim 1, further comprising:

a mode setting receiving unit configured to receive a command selectively specifying recoding modes, the selectable recording modes including: a single-sided recording mode in which an image is recorded only on a front side of the recording medium; and a double-sided recording mode in which images are recorded on both front and rear sides of the recording medium.

4. The imager recording apparatus according to claim 3, wherein the control unit performs the stop operation on a condition that the mode setting receiving unit has received the double-sided recording mode.

5. The image recording apparatus according to claim 4, wherein the control unit is configured to convey the recording medium without performing the stop operation after an image is recorded on the rear side of the recording medium.

6. The image recording apparatus according to claim 3, wherein the control unit is configured to convey the recording medium without performing the stop operation on a condition that the mode setting receiving unit has received the single-sided recording mode.

7. The image recording apparatus according to claim 1, wherein, in the stop operation, the control unit stops the first roller pair and the second roller pair while tensile force remains arisen in a vicinity of the second end of the recording medium.

8. The image recording apparatus according to claim 1, wherein the first roller pair comprises a first drive roller and a first driven roller, wherein the second roller pair comprises a second drive roller and the second driven roller, wherein the second drive roller has a larger diameter than the first drive roller.

9. The image recording apparatus according to claim 8, wherein the control unit is configured to control the first drive roller and the second drive roller to rotate at a same angular velocity.

10. The image recording apparatus according to claim 1, wherein the image recording apparatus is configured to operate in a double-sided recording mode in which images are recorded on both front and rear sides of the recording medium, and wherein, when the image recording apparatus is operating in the double-sided recording mode, the recording medium is conveyed toward a discharging tray in the conveying direction and then the recorded medium is conveyed in a direction opposite to the conveying direction, toward an inversion path.

11. An image recording apparatus comprising:

a conveying path on which a recording medium is allowed to be conveyed in a conveying direction, the recording medium having a first end and a second end opposite to the first end with respect to the conveying direction;

a recording unit disposed in the conveying path and configured to perform an image recording operation to record an image on the recording medium by ejecting ink droplets;

a spur disposed in the conveying path and downstream of the recording unit with respect to the conveying direction;

an inversion guide portion that connects a downstream portion positioned at the conveying path downstream of the recording unit to an upstream portion positioned at the conveying path upstream of the recording unit;

a path changeover unit disposed at the downstream portion and configured to send the recording medium conveyed from the recording unit with the first end as a leading end to the inversion guide portion with the second end as a leading end; and a control unit configured to control a conveying velocity of the recording medium, wherein the control unit is configured to perform a deceleration operation in which the conveying velocity is decelerated after the image recording operation for a front side of the recording medium is completed and before the second end passes by the spur, wherein the control unit controls the conveying velocity to convey the recording medium at a second conveying velocity after the second end has passed by the spur, and wherein, in the deceleration operation, the control unit controls the conveying velocity to convey the recording medium at a first conveying velocity lower than the second conveying velocity.

12. The image recording apparatus according to claim 11, wherein, during the image recording operation, the control unit controls the conveying velocity to convey the recording medium at a third conveying velocity, wherein, in the deceleration operation, the control unit controls the conveying velocity to convey the recording medium at the first conveying velocity lower than the third conveying velocity.

13. The image recording apparatus according to claim 12, wherein the second conveying velocity is higher than the third conveying velocity.

14. The image recording apparatus according to claim 11, further comprising:

a mode setting receiving unit configured to receive a command selectively specifying recoding modes, the selectable recording modes including: a single-sided recording mode in which an image is recorded only on a front side of the recording medium; and a double-sided recording mode in which images are recorded on both front and rear sides of the recording medium.

15. The image recording apparatus according to claim 14, wherein the control unit performs the deceleration operation on a condition that the mode setting receiving unit has received the double-sided recording mode.

16. The image recording apparatus according to claim 15, wherein the control unit is configured to convey the recording medium without performing the deceleration operation after an image is recorded on the rear side of the recording medium.

17. The image recording apparatus according to claim 16, wherein the control unit is configured to control the conveying velocity to convey the recording medium at the second conveying velocity after the image is recorded on the rear side of the recording medium.

18. The image recording apparatus according to claim 14, wherein the control unit is configured to convey the recording medium without performing the deceleration operation on a condition that the mode setting receiving unit has received the single-sided recording mode.

19. The image recording apparatus according to claim 18, wherein the control unit is configured to control the conveying velocity to convey the recording medium at the second conveying velocity after the image is recorded on the front side of the recording medium.

20. The image recording apparatus according to claim 11, wherein the control unit performs the deceleration operation to temporarily stops the conveyance of the recording medium during a term from a completion of the image recording operation for the front side of the recording medium to the second end to pass by the spur.

21. An image recording apparatus comprising:

a conveying path on which a recording medium is allowed to be conveyed in a conveying direction, the recording medium having a first end and a second end opposite to the first end with respect to the conveying direction;

a recording unit disposed in the conveying path and configured to perform an image recording operation to record an image on the recording medium by ejecting ink droplets;

a spur disposed in the conveying path and downstream of the recording unit with respect to the conveying direction;

an inversion guide portion that connects a downstream portion positioned at the conveying path downstream of the recording unit to an upstream portion positioned at the conveying path upstream of the recording unit;

a path changeover unit disposed at the downstream portion and configured to send the recording medium conveyed from the recording unit with the first end as a leading end to the inversion guide portion with the second end as a leading end; and a control unit configured to control a conveying velocity of the recording medium, wherein the control unit is configured to perform a deceleration operation in which the conveying velocity is decelerated such that ink adhering to the recording medium is dried after the image recording operation for a front side of the recording medium is completed and before the second end passes by the spur.

* * * * *